US009338552B2

(12) United States Patent
Barton

(10) Patent No.: US 9,338,552 B2
(45) Date of Patent: May 10, 2016

(54) COINCIDING LOW AND HIGH FREQUENCY LOCALIZATION PANNING

(71) Applicant: Geoffrey J. Barton, Dunstable (GB)

(72) Inventor: Geoffrey J. Barton, Dunstable (GB)

(73) Assignee: TRIFIELD IP, LLC, Lancaster, PA (US)

( * ) Notice: Subject to any disclaimer, the term of this patent is extended or adjusted under 35 U.S.C. 154(b) by 138 days.

(21) Appl. No.: 14/273,647

(22) Filed: May 9, 2014

(65) Prior Publication Data

US 2015/0326972 A1 Nov. 12, 2015

(51) Int. Cl.
*H04R 3/04* (2006.01)
*H04S 5/00* (2006.01)

(52) U.S. Cl.
CPC .. *H04R 3/04* (2013.01); *H04S 5/00* (2013.01); *H04R 2430/00* (2013.01); *H04S 2420/07* (2013.01)

(58) Field of Classification Search
None
See application file for complete search history.

(56) References Cited

U.S. PATENT DOCUMENTS

| | | | |
|---|---|---|---|
| 3,997,725 | A | 12/1976 | Gerzon |
| 4,042,779 | A | 8/1977 | Craven et al. |
| 4,081,606 | A | 3/1978 | Gerzon |
| 4,086,433 | A | 4/1978 | Gerzon |
| 4,095,049 | A | 6/1978 | Gerzon |
| 4,139,729 | A | 2/1979 | Gerzon |
| 4,151,369 | A | 4/1979 | Gerzon |
| 4,270,177 | A | 5/1981 | Endoh et al. |
| 4,414,430 | A | 11/1983 | Gerzon |
| 4,509,185 | A | 4/1985 | Grunberg |
| 4,648,115 | A | 3/1987 | Sakashita |
| 4,648,116 | A | 3/1987 | Joshua |
| 4,910,778 | A | 3/1990 | Barton |
| 5,127,306 | A | 7/1992 | Mitsuhashi et al. |
| 5,418,856 | A | 5/1995 | Okamoto |
| 5,511,129 | A | 4/1996 | Craven et al. |
| 5,555,306 | A | 9/1996 | Gerzon |
| 5,594,800 | A | 1/1997 | Gerzon |
| 5,627,899 | A | 5/1997 | Craven et al. |
| 5,671,287 | A | 9/1997 | Gerzon |
| 5,696,834 | A | 12/1997 | Kitagawa |
| 5,757,927 | A | 5/1998 | Gerzon et al. |

(Continued)

FOREIGN PATENT DOCUMENTS

| | | | |
|---|---|---|---|
| DE | 199 00 819 | A1 | 7/2000 |
| JP | S58190198 | A | 11/1983 |

(Continued)

OTHER PUBLICATIONS

International Search Report and Written Opinion dated Jul. 30, 2015 for corresponding International application No. PCT/IB2015/053397.

(Continued)

*Primary Examiner* — Brenda Bernardi
(74) *Attorney, Agent, or Firm* — Renner, Otto, Boisselle & Sklar, LLP

(57) ABSTRACT

A method of panning includes panning an input signal or a low frequency portion of the input signal to split the input signal or the low frequency portion of the input signal into first and second channels, panning the input signal or a high frequency portion of the input signal to split the input signal or the high frequency portion of the input signal into third and fourth channels such that localization of the high frequency portion of the input signal coincides with localization of the low frequency portion of the input signal.

33 Claims, 17 Drawing Sheets

(56) References Cited

U.S. PATENT DOCUMENTS

| | | | | |
|---|---|---|---|---|
| 5,815,580 | A | 9/1998 | Craven et al. | |
| 6,005,946 | A | 12/1999 | Varga et al. | |
| 6,281,885 | B1 | 8/2001 | Eastty et al. | |
| 6,614,910 | B1 | 9/2003 | Clemow et al. | |
| 6,664,913 | B1 | 12/2003 | Craven et al. | |
| 6,683,959 | B1 | 1/2004 | Kuwano et al. | |
| 6,760,451 | B1 | 7/2004 | Craven et al. | |
| 6,782,108 | B2 | 8/2004 | Shibata | |
| 6,784,812 | B2 | 8/2004 | Craven et al. | |
| 6,801,630 | B1 | 10/2004 | Shibata | |
| 6,891,482 | B2 | 5/2005 | Craven et al. | |
| 7,046,813 | B1 * | 5/2006 | Denda | G09B 5/04 381/98 |
| 7,330,552 | B1 | 2/2008 | LaMance | |
| 8,023,659 | B2 | 9/2011 | Hamanaka et al. | |
| 8,035,024 | B2 | 10/2011 | Ludwig | |
| 8,121,714 | B2 | 2/2012 | Yamashita et al. | |
| 8,204,614 | B2 | 6/2012 | Yamashita et al. | |
| 8,462,970 | B2 | 6/2013 | Mouhssine et al. | |
| 2003/0059067 | A1 | 3/2003 | Shibata | |
| 2003/0152241 | A1 | 8/2003 | Eastty et al. | |
| 2004/0163528 | A1 | 8/2004 | Ludwig | |
| 2005/0157894 | A1 | 7/2005 | Andrews et al. | |
| 2008/0024434 | A1 | 1/2008 | Isozaki | |
| 2008/0269930 | A1 | 10/2008 | Yamashita et al. | |
| 2009/0034766 | A1 | 2/2009 | Hamanaka et al. | |
| 2009/0074209 | A1 | 3/2009 | Thompson et al. | |
| 2010/0222904 | A1 | 9/2010 | Yamashita et al. | |
| 2010/0241439 | A1 | 9/2010 | Mouhssine et al. | |
| 2010/0329466 | A1 | 12/2010 | Berge | |

FOREIGN PATENT DOCUMENTS

| | | |
|---|---|---|
| WO | 93/18630 | 9/1993 |
| WO | 2008/064050 | 5/2008 |

OTHER PUBLICATIONS

Gerzon, Michael A, "General Metatheory of Auditory Localisation" An Audio Engineering Society Preprint, 64 pages, Mar. 24-27, 1992. Oxford UK.

Gerzon, Michael A., "Surround-sound Psychoacoustics: Criteria for the Design of Matrix and Discrete Surround-Sound Systems" Wireless World, 6 pages, Dec. 1974. Oxford UK.

* cited by examiner

COINCIDING LOW AND HIGH FREQUENCY LOCALIZATION PANNING

BACKGROUND

The present disclosure relates to improving the function of a panoramic potentiometer ("pan-pot") which is a hardware or software device used in the broadcast and recording industry to split or mix monophonic ("mono") audio sources to form multi-channel audio such as stereophonic ("stereo"), 3.1, 5.1 or 7.1 surround, etc.

A pan-pot operates by feeding a selected proportion of a mono audio signal to two or more channels intended for subsequent reproduction by loudspeakers or headphones. By operation of the pan-pot, the mono signal may be effectively "localized" between the two or more channels so that the audio appears to the listener to originate from a particular direction.

Michael Gerzon outlined two of the principal mechanisms that humans use to localize sound images presented to the listener over an array of loudspeakers. At low frequencies (i.e., below about 700 Hz) Gerzon's velocity vector localization theory is appropriate whereas at high frequencies (i.e., from about 700 Hz to about 5 kHz) his energy vector localization model is appropriate.

In some cases, however, low frequency localization angles according to velocity vector localization diverges from high frequency localization angles according to energy vector localization. The effect of this divergence in localization angles may be audible, particularly on wide-band audio sources that contain low and higher frequency audio. In the case that the low frequency localization is correct the sound may also appear to have undesirable width at higher frequencies and may sound blurred and unstable.

SUMMARY

The present disclosure describes novel techniques for panning. Specifically, the present disclosure describes systems and methods for panning of audio sources such that localization of low frequencies of the audio sources coincides with localization of high frequencies of the audio sources.

The techniques disclosed herein may find particular application in the fields of broadcast and consumer audio. These techniques may be applied to stereo audio or multichannel audio of more than two channels, including but not limited to common formats such as 5.1 or 7.1 channels. These techniques may be also be applied to systems which use channel based and/or object based audio to convey additional dimensions and reality. Examples of channel and object based audio can be found in the MPEG-H or Dolby AC-4 systems.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
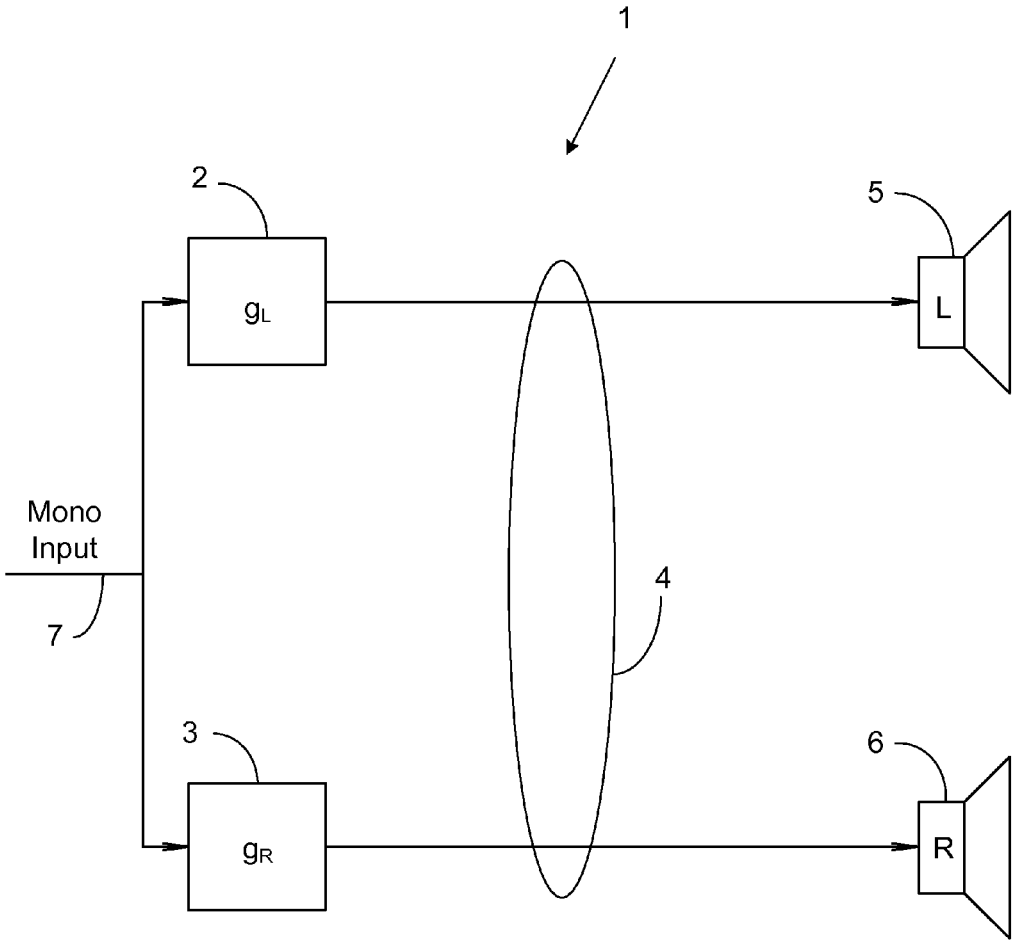
FIG. 1 illustrates a schematic drawing of an exemplary system for panning.

FIG. 1 illustrates a schematic drawing of an exemplary system 1 for panning. The system 1 includes a left gain block 2, a right gain block 3, a transmission or recording channel 4, a left loudspeaker 5 and a right loudspeaker 6. The system 1 receives a monophonic ("mono") input signal 7 and applies the mono signal 7 to the left gain block 2 and the right gain block 3 for panning or localizing of the mono signal 7 between the left and right loudspeakers 5 and 6. The combination of the left gain block 2 and the right gain block 3 is commonly referred to as a panoramic potentiometer or pan-pot and is typically controlled by a user-accessible knob or a computer graphic representation of a knob. The left gain block 2 and the right gain block 3 are linked in a pre-determined manner by a so-called "pan control law" or "pan-pot law."

For example, for the signal 7 to be localized or to appear to come from the direction of the left loudspeaker 5, the gain $g_L$ of the gain block 2 will typically be unity and the gain $g_R$ of the gain block 3 will be zero. For the signal 7 to be localized midway between the left and right loudspeakers 5 and 6, the gains $g_L$ and $g_R$ will typically be equal and in the range between 0.5 and 0.7071 approximately.

The pan control law may be analytic and continuous, in which case a typical law will be given by:

$$A=\sin(\phi+45) \quad \text{Eq. 1}$$

$$B=\cos(\phi+45) \quad \text{Eq. 2}$$

where $\phi$ is an angle nominally zero when the control is directed straight ahead of the listener and ranging ±45° as a sound image is moved towards either loudspeaker. The angle $\phi$ is arbitrary and varies linearly with the control position. The convention used in the present disclosure is that positive values of $\phi$ cause the image to move towards the left loudspeaker 5 and negative values cause the image to move towards the right speaker 6.

The pan control law represented by equations 1 and 2 gives constant power irrespective of panning position, as can be easily verified by calculating $A^2+B^2$ from equations 1 and 2 as:

$$\sin^2(\phi+45)+\cos^2(\phi+45)=1 \quad \text{Eq. 3}$$

This means that the panned signal resulting from use of the pan control law of equations 1 and 2 will have the same loudness irrespective of localization as the total acoustic energy from the loudspeakers is constant regardless of panning position. This is a highly desirable property for normal mixing use.

To determine the apparent localization for any pan-pot law we can use the theorems of Michael Gerzon, explained in U.S. Pat. No. 5,594,800 issued on Jan. 14, 1997 (hereinafter "Gerzon's '800 patent") and more comprehensibly in Gerzon, M. A. 'General Metatheory of Auditory Localisation', AES 92$^{nd}$ convention, 1992, preprint 3306 (hereinafter "Gerzon's General Metatheory"), both of which are incorporated here by reference. In these documents, Gerzon outlined two of the principal mechanisms that humans use to localize a sound image presented over an array of loudspeakers in front of a listener. At frequencies below about 700 Hz his velocity vector localization theory is appropriate whereas from about 700 Hz to about 5 kHz his energy vector localization model is appropriate.

Figure 2:
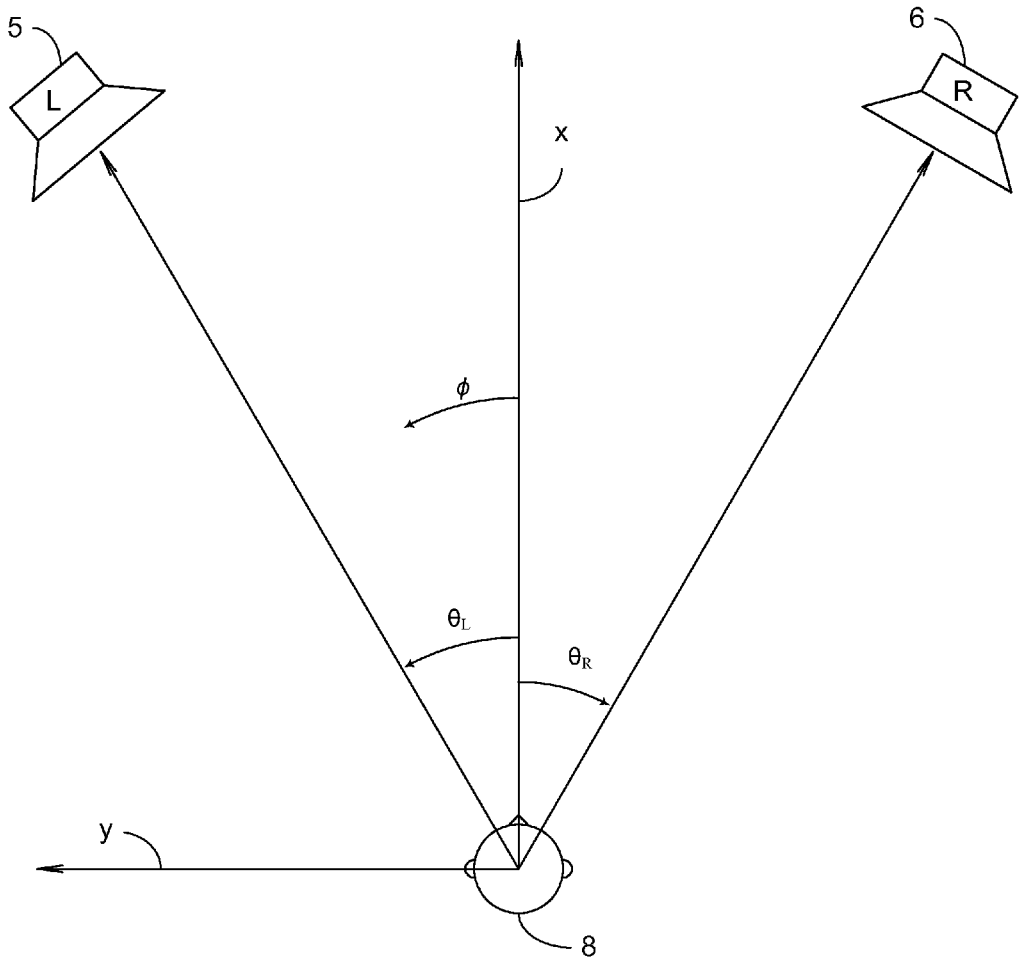
FIG. 2 illustrates an exemplary arrangement in which a forward facing listener is presented with a stereo image from loudspeakers.

FIG. 2 illustrates an arrangement in which a forward facing listener 8 is presented with a stereo image from the loudspeakers 5 and 6. A set of coordinate axes is defined with x pointing forwards from the listener 8 and y pointing left of the listener 8. Angles are measured positively moving from x towards y. Thus loudspeaker 5 is at a positive azimuth $\theta_L$ and loudspeaker 6 is at a negative azimuth $\theta_R$.

If the input signal, signal 7 in FIG. 1, is of unit amplitude and the electrical plus acoustic gain from the left loudspeaker 5 is defined as $G_L$ and the electrical plus acoustic gain from the right loudspeaker 6 is defined as $G_R$, then in FIG. 2 at the listener 8 the total pressure gain P due to the loudspeakers 5 and 6 is:

$$P=G_L+G_R \quad \text{Eq. 4}$$

and the total energy gain E is:

$$E=|G_L|^2+|G_R|^2 \quad \text{Eq. 5}$$

The sound intensity at the listener 8 due to the loudspeakers 5 and 6 may be resolved into two components: $e_x$ and $e_y$, along their respective axes in FIG. 2. These may be written as:

$$e_x=|G_L|^2\cos\theta_L+|G_R|^2\cos\theta_R \quad \text{Eq. 6}$$

$$e_y=|G_L|^2\sin\theta_L+|G_R|^2\sin\theta_R \quad \text{Eq. 7}$$

Then, according to Gerzon's energy vector theory:

$$r_e\cos\theta_e=\frac{e_x}{E} \quad \text{Eq. 8}$$

$$r_e\sin\theta_e=\frac{e_y}{E} \quad \text{Eq. 9}$$

where $r_e$ is the energy vector ratio, which is greater than zero. For a real source, or a sound coming from a single loudspeaker, $r_e=1$. $\theta_e$ is the energy vector direction, which points in the apparent direction of the panned audio image.

Using the velocity vector theory, the resolved velocity vector gains may be written as:

$$v_x=G_L\cos\theta_L+G_R\cos\theta_R \quad \text{Eq. 10}$$

$$v_y=G_L\sin\theta_L+G_R\sin\theta_R \quad \text{Eq. 11}$$

and $$r_v\cos\theta_v=\mathrm{Re}\left(\frac{v_x}{P}\right) \quad \text{Eq. 12}$$

$$r_v\sin\theta_v=\mathrm{Re}\left(\frac{v_y}{P}\right) \quad \text{Eq. 13}$$

where "Re" means "the real part of" as, in general, only the real part of the vector contributes to the localization. $r_v$ is the velocity vector gain and $\theta_v$ is the apparent source direction according to the velocity vector theory.

Figure 3:
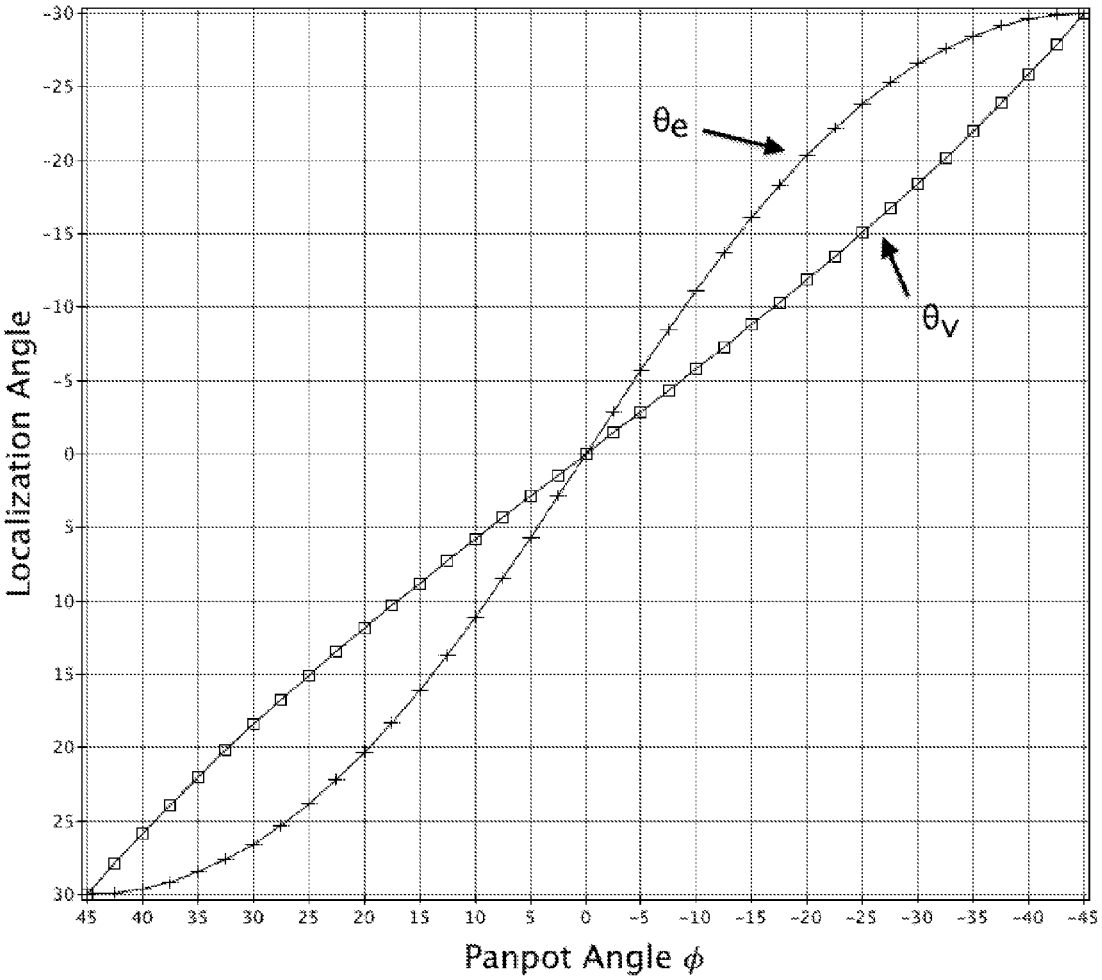
FIG. 3 illustrates a graph in which velocity and energy vector localizations appear plotted against the pan-pot angle.

FIG. 3 illustrates a graph in which $\theta_e$ and $\theta_v$ appear plotted against the pan-pot angle, which is $\phi$ in equations 1 and 2 above. For the graph of FIG. 3, $\theta_L$ and $\theta_R$ (see FIG. 2 above) are 30 degrees and −30 degrees, respectively. Thus the loudspeaker setup is typical of a normal stereo system, where the loudspeakers subtend 60 degrees at the listener. From the graph of FIG. 3 it may be seen that the pan control law results in nearly linear proportionality in $\theta_v$ with control setting, but that $\theta_e$ diverges from $\theta_v$ apart from at settings corresponding to the two loudspeakers 5 and 6 (i.e., hard left and hard right) and also at the central position.

The effect of this divergence in localization angles is particularly audible on wide-band audio sources. These are sources that contain low frequencies, say up to 600 Hz, and also higher frequencies such as harmonic partials or other content from the source. Thus, typically, for sounds panned in between the center point and either loudspeaker, the image is more blurred and unstable, having undesired width. Ideally, a panned mono source should have zero width; it should be a point source. Quantitatively, it can be seen in FIG. 3 that, for example, at about 30 degrees pan-pot angle, the $\theta_e$ and $\theta_v$ localization angles differ by about 8 degrees, representing an "error" of about 26%. Application of the principles disclosed herein may reduce this error substantially to zero.

Figure 4:
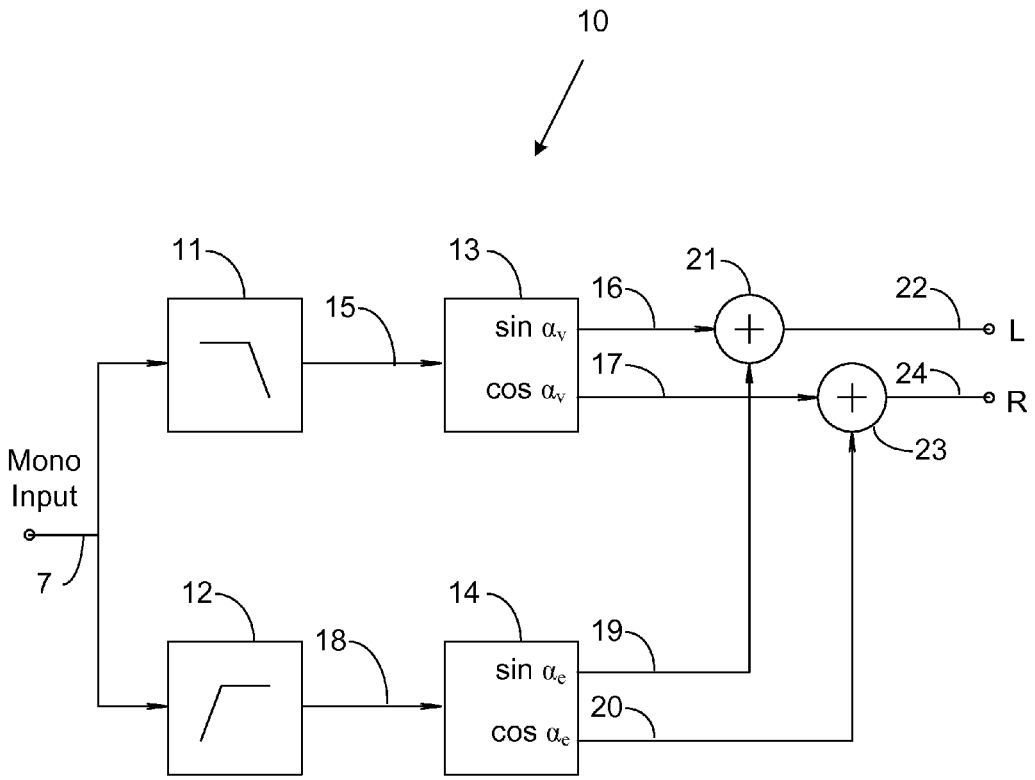
FIG. 4 illustrates a block diagram of an exemplary panning apparatus.

FIG. 4 illustrates a block diagram of an exemplary panning apparatus 10. The apparatus 10 includes a low-pass filter 11 and a high-pass filter 12 that receive the input signal 7 (e.g., a mono input). Preferably the characteristics of the low-pass filter 11 and the high-pass filter 12 are such that the signals at the filter outputs are in-phase through the cross-over frequency and would sum to unity gain over the audible frequency range if combined. The apparatus 10 also includes a low frequency pan-pot 13 and a high frequency pan-pot 14.

The low frequency pan-pot 13 receives a low frequency portion 15 of the input signal 7 (i.e., the output of the low-pass filter 11) and splits the low frequency portion 15 into first and second low frequency channels 16 and 17, respectively, to localize the low frequency portion 15 between the first and second low frequency channels 16 and 17.

The high frequency pan-pot 14 receives a high frequency portion 18 of the input signal 7 (i.e., the output of the high-pass filter 12) and splits the high frequency portion 18 into first and second high frequency channels, 19 and 20, respectively, to localize the high frequency portion 18 between the first and second high frequency channels 19 and 20.

The apparatus 10 also includes a first adder 21 that adds the first low frequency channel 16 to the first high frequency channel 19 to form a first output signal 22. The apparatus 10 also includes a second adder 23 that adds the second low frequency channel 17 to the second high frequency channel 20 to form a second output signal 24. The first and second output signals 22 and 24 may form a stereo output.

Different pan control laws may be applied to the pan-pots 13 and 14. This means that the pan-pots 13 and 14 may be set to different pan-pot angles $\alpha_v$ and $\alpha_e$ respectively, where $\alpha_v$ and $\alpha_e$ may range between 90 degrees (i.e., fully left) and zero (i.e., fully right). This allows the pan-pot angle to be set differently for frequencies in the high-frequency portion 18 from that in the low-frequency portion 15, thus allowing separate optimization of the energy vector localization at high frequencies from the velocity vector localization at low frequencies.

In the embodiment of FIG. 4, localization of the high frequency portion 18 between the first and second high frequency channels 19 and 20 is set to coincide with localization of the low frequency portion 15 between the first and second low frequency channels 16 and 17. That is, $\alpha_e$ is set for a given setting of $\alpha_v$ or vice versa, such that the high frequency localization curve coincides with the low-frequency localization curve.

To determine the optimum setting of $\alpha_e$ for a given setting of $\alpha_v$ we equate the expressions for high-frequency and low-frequency localization. Dividing equation 9 by equation 8 gives:

$$\frac{e_y}{e_x} = \frac{\sin\theta_e}{\cos\theta_e} \quad \text{Eq. 14}$$

and dividing equation 13 by equation 12 gives:

$$\frac{\mathrm{Re}(v_y)}{\mathrm{Re}(v_x)} = \frac{\sin\theta_v}{\cos\theta_v} \quad \text{Eq. 15}$$

For identical energy and velocity vector localizations, equation 14 must equal equation 15 at any setting of $\alpha_v$ and $\alpha_e$.

Substituting $\sin\theta_e$ for $G_L$ and $\cos\alpha_e$ for $G_R$ in equations 6 and 7, and putting $\theta_R=-\theta_L$, then equation 6 becomes:

$$e_x=\sin^2\alpha_e\cos\theta_L+\cos^2\alpha_e\cos(-\theta_L) \quad \text{Eq. 16}$$

and equation 7 becomes:

$$e_y=\sin^2\alpha_e\sin\theta_L+\cos^2\alpha_e\sin(-\theta_L) \quad \text{Eq. 17}$$

Dividing equation 17 by equation 16 and simplifying gives:

$$\frac{e_y}{e_x} = \frac{(\sin^2\alpha_e - \cos^2\alpha_e)\sin\theta_L}{(\sin^2\alpha_e + \cos^2\alpha_e)\cos\theta_L} \quad \text{Eq. 18}$$

Similarly, substituting $\sin\alpha_v$ for $G_L$, $\cos\alpha_v$ for $G_R$ and putting $\theta_R=-\theta_L$ in equations 10 and 11 gives:

$$\frac{v_y}{v_x} = \frac{(\sin\alpha_v - \cos\alpha_v)\sin\theta_L}{(\sin\alpha_v + \cos\alpha_v)\cos\theta_L} \quad \text{Eq. 19}$$

Then putting:

$$\frac{e_y}{e_x} = \frac{v_y}{v_x} \quad \text{Eq. 20}$$

according to equations 14 and 15 to equate $\theta_e$ and $\theta_v$. Here $v_x$ and $v_y$ are both real by design. After some manipulation, the expression for $\alpha_e$ in terms of $\alpha_v$ becomes:

$$\alpha_e = \frac{1}{2}\cos^{-1}\left(\frac{\cos\alpha_v - \sin\alpha_v}{\cos\alpha_v + \sin\alpha_v}\right) \quad \text{Eq. 21}$$

Figure 5:
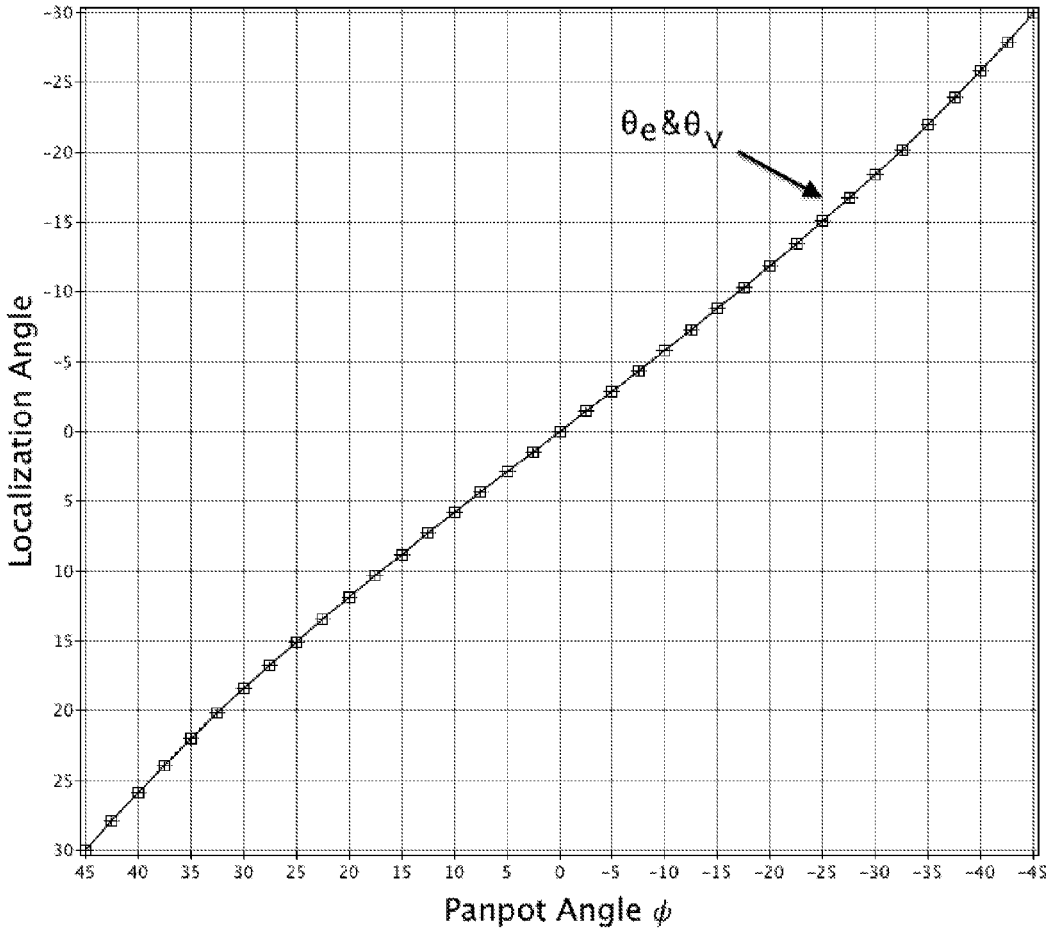
FIG. 5 illustrates a graph similar to that of FIG. 3 in which coinciding velocity and energy vector localizations appear plotted against the pan-pot angle.

FIG. 5 illustrates a graph similar to that of FIG. 3 in which $\theta_e$ and $\theta_v$ appear plotted against the pan-pot angle $\phi$ with the exception that in FIG. 5 the $\theta_e$ curve is calculated using the value of $\alpha_e$ from equation 21. As may be seen from FIG. 5, the high frequency energy vector curve now coincides with the low frequency velocity vector curve.

In the embodiment of FIG. 5, the high frequency energy vector curve, the $\theta_e$ curve, is calculated as a function of the low frequency velocity vector $\theta_v$. In another embodiment, the low frequency velocity vector $\theta_v$ is calculated as a function of the high frequency energy vector $\theta_e$. In yet another embodiment, the high frequency energy vector $\theta_e$ and the low frequency velocity vector $\theta_v$ are calculated relative to each other (e.g., mean, median, square root of the product, etc.)

For mathematical convenience and for clarity of explanation, the embodiment of FIG. 4 illustrates the pan-pots 13 and 14 as having sin/cos characteristics. However, the above analysis holds for arbitrary panning laws. Frequently pan-pots may not have exactly sin/cos laws, or may be calculated from look-up tables not necessarily derived from analytic functions. It is therefore convenient to be able to calculate a new high frequency pan-pot law or low frequency pan-pot law or both from an existing law which is available only as two numbers representing the signal gain for the two channels (e.g., left and right channels).

Let low frequency panning gains be $L_o$ and $R_o$ and high frequency panning gains be $L_e$ and $R_e$, to be derived from $L_o$ and $R_o$. Substituting $L_e$ and $R_e$ into equations 6 and 7, and $\theta_R=-\theta_L$ $$e_x=L_e^2\cos\theta_L+R_e^2\cos(-\theta_L) \quad \text{Eq. 22}$$

$$e_y=L_e^2\sin\theta_L+R_e^2\sin(-\theta_L) \quad \text{Eq. 23}$$

Similarly, substituting for $L_o$, $R_o$ and $\theta_R=-\theta_L$ in equations 10 and 11:

$$v_x=L_o\cos\theta_L+R_o\cos(-\theta_L) \quad \text{Eq. 24}$$

$$v_y=L_o\sin\theta_L+R_o\sin(-\geq_L) \quad \text{Eq. 25}$$

And again putting:

$$\frac{e_y}{e_x} = \frac{v_y}{v_x} \quad \text{Eq. 26}$$

yields the following:

$$\frac{(L_e^2 - R_e^2)\sin\theta_L}{(L_e^2 + R_e^2)\cos\theta_L} = \frac{(L_o - R_o)\sin\theta_L}{(L_o + R_o)\cos\theta_L} \quad \text{Eq. 27}$$

In order to avoid changes in balance, so that the level of a sound in any frequency band is the same after the pan law is modified, the total power must be unchanged. That is:

$$L_e^2+R_e^2=L_o^2+R_o^2 \quad \text{Eq. 28}$$

Substituting this into equation 27 and solving for $L_e$ gives:

$$L_e = \sqrt{L_o^2 + R_o^2}\sqrt{\frac{L_o}{L_o + R_o}} \quad \text{Eq. 29}$$

And substituting this back into equation 28 to solve for $R_e$ gives:

$$R_e = \sqrt{L_o^2 + R_o^2} \cdot \sqrt{\frac{R_o}{L_o + R_o}} \quad \text{Eq. 30}$$

Thus, for any pair of low frequency gains $L_o$ and $R_o$, equations 29 and 30 allow the calculation of the values for the high frequency gains $L_e$ and $R_e$ which will give identical panning locations to the arbitrary $L_o$ and $R_o$ pair at lower frequencies.

The above analysis has been based on the assumption that the velocity vector localization curve was substantially linear with control setting (see FIG. 3) and thus it was desirable to derive the energy vector localization curve to match the velocity vector localization. In some cases, however, using the energy vector curve as the reference and deriving the velocity vector curve to match the energy vector curve may be desirable.

Figure 6A:
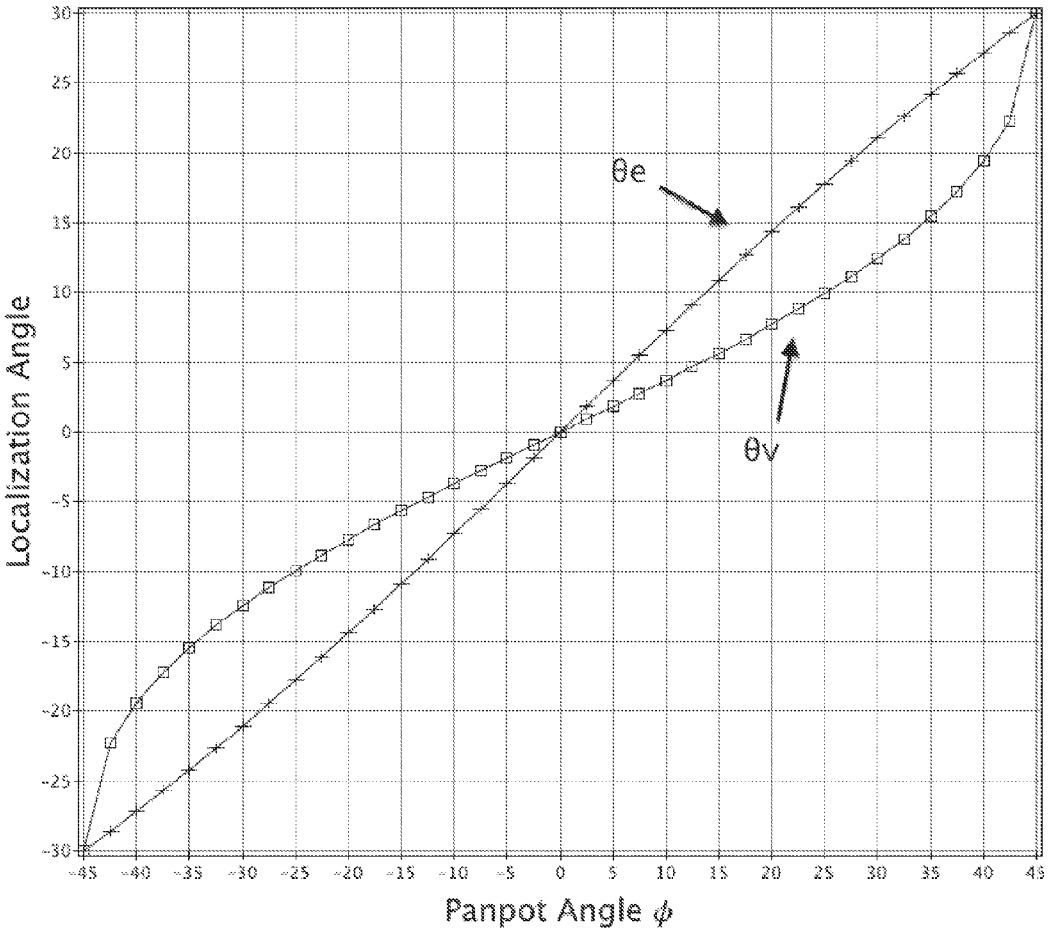
FIG. 6A illustrates a graph in which velocity and energy vector localizations appear plotted against the pan-pot angle.

FIG. 6A illustrates a graph in which $\theta_e$ and $\theta_v$ appear plotted against the pan-pot angle $\phi$. In FIG. 6A it is the energy vector localization curve which is substantially linear with control setting and thus it is desirable to use the energy vector curve as the reference and match the velocity vector curve to it. For the example in FIG. 6A the pan control law is given by $L=\sqrt{\gamma}$ and $R=\sqrt{1-\gamma}$ where $\phi$ is the linear pan-pot angle as above and $$\gamma = \frac{(\phi + 45)}{90},$$

so it runs from 0 at the right loudspeaker to 1 at the left loudspeaker. It is a constant power law as $L^2+R^2=1$ for $0\leq\gamma\leq1$. The analysis is as above except equation 27 must now be solved for $L_o$ and $R_o$ with the user control now setting the high frequency settings $L_e$ and $R_e$ directly and the low frequency values being derived from solving equation 27 as:

$$L_o = \frac{L_e^2}{\sqrt{L_e^2 + R_e^2}} \quad \text{Eq. 31}$$

and $$R_o = \frac{R_e^2}{\sqrt{L_e^2 + R_e^2}} \quad \text{Eq. 32}$$

Thus, for any pair of high frequency gains $L_e$ and $R_e$, equations 44 and 45 allow the calculation of the low frequency gains $L_o$ and $R_o$ which will give identical panning locations.

In another embodiment, the low frequency gains $L_o$ and $R_o$ and the high frequency gains $L_e$ and $R_e$ may be calculated independently according to Gerzon's velocity vector and energy vector theories, respectively. Values for low frequency and high frequency localization may be then calculated as a combined function (e.g., mean, median, square root of the product, etc.) of the low frequency gains $L_o$ and $R_o$ and the high frequency gains $L_e$ and $R_e$.

In yet another embodiment, the pan-pot law may be designed such that one of the low frequency curve or the high frequency curve gives a linear graph (at the desired angle subtended by the speakers at the listener, as it does vary a small amount with angle). Then the other one of the low frequency or the high frequency curve may be determined as explained above to match the linearity of the first curve.

In one embodiment, the image location is made to be linearly related to the control position as the image rotates between the left and right loudspeakers (rather than in a straight line as pan controls are usually rotary). In terms of the parameters defined above, this may be expressed as:

$$\theta_e=\theta_v=\alpha*(\theta_L-\theta_R) \quad \text{Eq. 33}$$

where $-1\leq\alpha\leq1$, i.e., the localization is proportional to the setting of the user controlled linear parameter $\alpha$.

For low frequencies, we can get an equation for $\tan\theta_v$ dividing equation 11 by equation 10 as follows:

$$\tan\theta_v = \frac{G_L - G_R}{G_L + G_R}\tan\theta_L \quad \text{Eq. 34}$$

and, for clarity setting $\tan\theta_v=t1$, $\tan\theta_L=t2$ and $$\frac{G_L}{G_R} = \gamma_v$$

gives:

$$\gamma_v = \frac{t1 + t2}{t2 - t1} \quad \text{Eq. 35}$$

and as before normalizing the power (i.e., $G_L^2+G_R^2=1$) and substituting $\theta_v$ (i.e., $G_L^2=\gamma_v^2G_R^2$) gives:

$$G_L = \frac{\gamma_V}{\sqrt{1 + \gamma_V^2}} \quad \text{Eq. 36}$$

and:

$$G_R = \frac{1}{\sqrt{1 + \gamma_V^2}} \quad \text{Eq. 37}$$

A similar calculation for high frequencies (i.e., $\theta_e$) gives:

$$\gamma_e^2 = \frac{t1 + t2}{t2 - t1} \quad \text{Eq. 38}$$

and:

$$G_L = \frac{\gamma_e}{\sqrt{1 + \gamma_e^2}} \quad \text{Eq. 39}$$

$$G_R = \frac{1}{\sqrt{1 + \gamma_e^2}} \quad \text{Eq. 40}$$

Figure 6B:
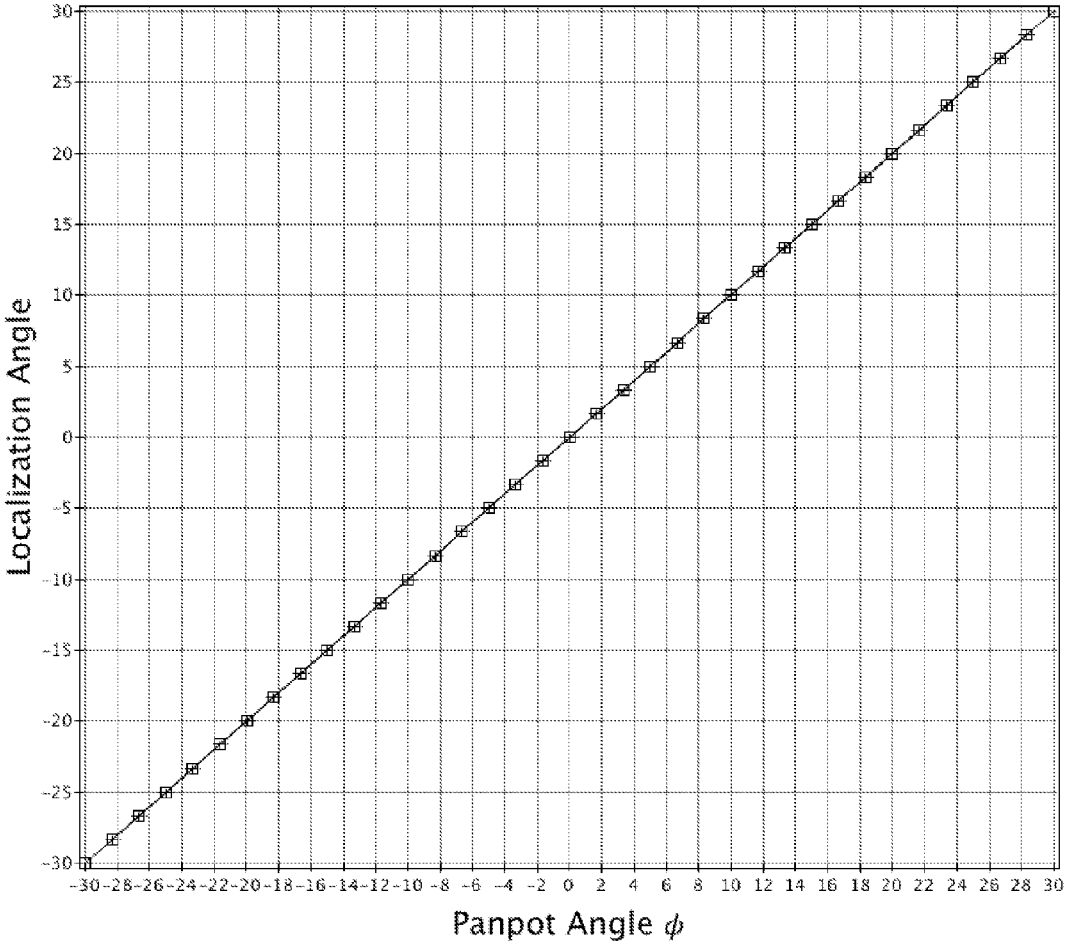
FIG. 6B illustrates another graph in which velocity and energy vector localizations appear plotted against the pan-pot angle.

FIG. 6B illustrates a graph in which $\theta_e$ and $\theta_v$ appear plotted against the pan-pot angle $\phi$. In FIG. 6B $\theta_e=\theta_v=\alpha^*(\theta_L-\theta_R)$, where $-1\leq\alpha\leq1$.

In another embodiment, the image location is made to be linear along the chord between the two loudspeakers in proportion to a linear control. The virtual image between two equidistant loudspeakers appears at the same distance as the loudspeakers, which implies that the image is on an arc between the loudspeakers. However, viewed strictly from the plane of the loudspeakers, the image will appear along the chord between them. This is less so for listeners above/below the plane and to some extent from side-side of the central position, so that the correct panning is along the arc as calculated above.

The above examples correspond to panning of a single monophonic input signal 7 to the stereophonic (i.e., left and right) output signals 22 and 24 of FIG. 4. But in addition to a single mono input signal, multiple mono signals may be panned.

Figure 7A:
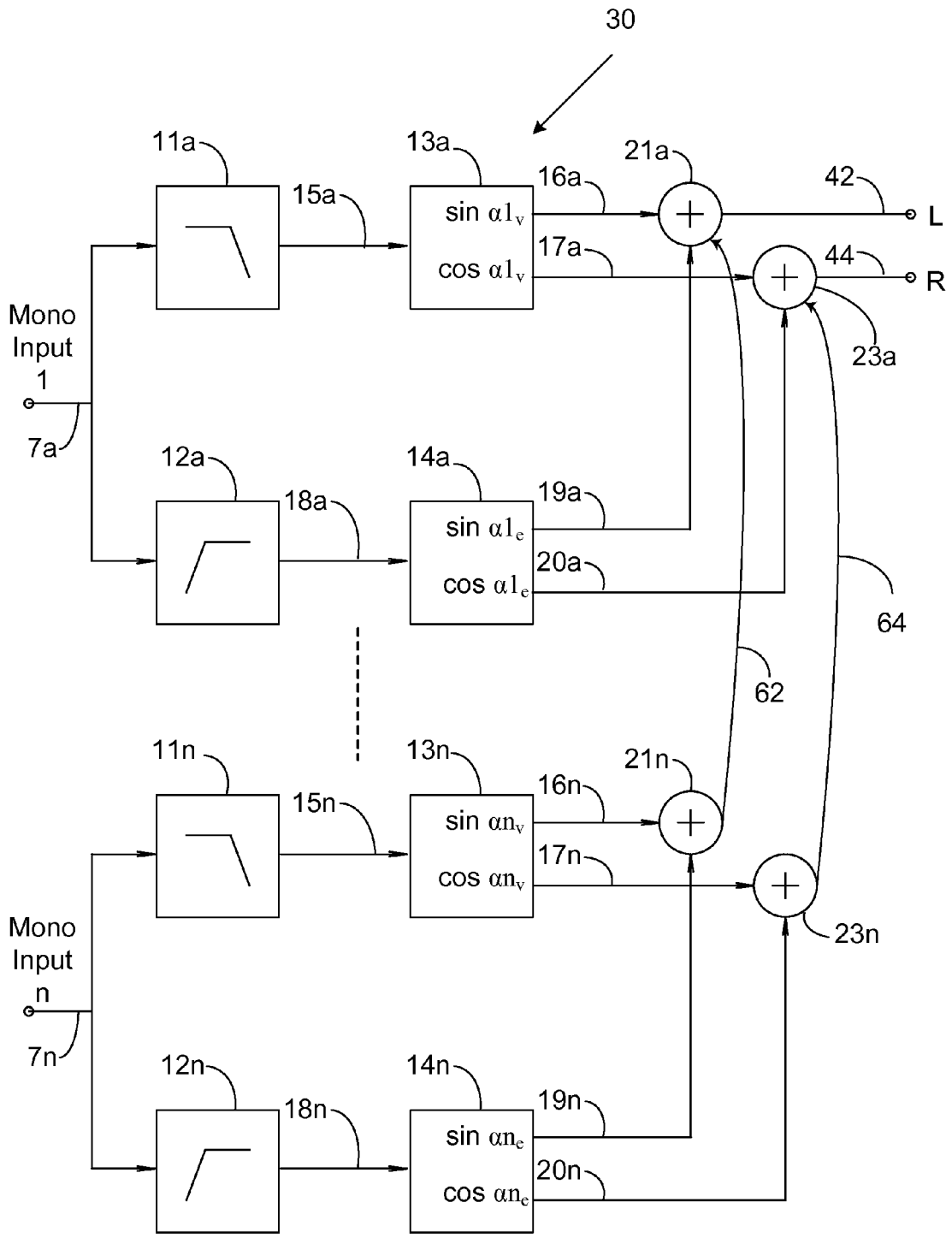
FIG. 7A illustrates a block diagram of an exemplary panning apparatus that receives multiple input signals.

FIG. 7A illustrates a block diagram of an exemplary panning apparatus 30 that receives multiple mono signals 7*a* and 7*n*. In the example of FIG. 7A only two of the possibly infinite number of mono input signals 7 and corresponding blocks 11, 12, 13 and 14 are shown. Therefore the nth signal 7*n* is herein referred to as the second signal. Similarly, corresponding nth elements such as pan-pots, filters, adders, etc. are herein referred to as second, third, fourth, etc. elements even though an infinite number of these elements is at least theoretically possible.

The apparatus 30 includes a low-pass filter 11*a* and a high-pass filter 12*a* that receive the first input signal 7*a* (e.g., a mono input). The apparatus 30 also includes a low-pass filter 11*n* and a high-pass filter 12*n* that receive the second input signal 7*n* (e.g., a mono input). The apparatus 30 also includes a first low frequency pan-pot 13*a* that receives a low frequency portion 15*a* of the first input signal 7*a* and splits the low frequency portion 15*a* of the first input signal 7*a* into first and second low frequency channels 16*a* and 17*a* to localize the low frequency portion 15*a* between the first and second low frequency channels 16*a* and 17*a*. The apparatus 30 also includes a first high frequency pan-pot 14*a* that receives a high frequency portion 18*a* of the first input signal 7*a* and splits the high frequency portion 18*a* into first and second high frequency channels 19*a* and 20*a* to localize the high frequency portion 18*a* between the first and second high frequency channels 19*a* and 20*a* to coincide with the localization of the low frequency portion 15*a* of the second input signal 7*a* between the first and second low frequency channels 16*a* and 17*a*.

The apparatus 30 also includes a first adder 41 that adds the first low frequency channel 16*a* and the first high frequency channel 19*a*. The apparatus 30 also includes a second adder 43 that adds the second low frequency channel 17*a* and the second high frequency channel 20*a*.

The apparatus 30 also includes a second low frequency pan-pot 13*n* that receives a low frequency portion 15*n* of the second input signal 7*n* and splits the low frequency portion 15*n* of the second input signal 7*n* into first and second low frequency channels 16*n* and 17*n* to localize the low frequency portion 15*n* between the first and second low frequency channels 16*n* and 17*n*. The apparatus 30 also includes a second high frequency pan-pot 14*n* that receives a high frequency portion 18*n* of the second input signal 7*n* and splits the high frequency portion 18*n* into first and second high frequency channels 19*n* and 20*n* to localize the high frequency portion 18*n* between the first and second high frequency channels 19*n* and 20*n* to coincide with the localization of the low frequency portion 15*n* between the first and second low frequency channels 16*n* and 17*n*.

The apparatus 30 also includes a third adder 21*n* that adds the first low frequency channel 16*n* and the first high frequency channel 19*n*. The sum 62 is then added to the first low frequency channel 16*a* and the first high frequency channel 19*a* to form the first output signal 42. The apparatus 30 also includes a fourth adder 23*n* that adds the second low frequency channel 17*n* and the second high frequency channel 20*n*. The sum 64 is then added to the second low frequency channel 17*a* and the second high frequency channel 20*a* to form the second output signal 44.

In one embodiment, the apparatus 30 does not include the third and fourth adders 21*n* and 23*n*, but instead the first low frequency channel 16*n* and the first high frequency channel 19*n* are added to the first low frequency channel 16*a* and the first high frequency channel 19*a* by the first adder 21*a* to form the first output signal 42. Similarly, the second low frequency channel 17*n* and the second high frequency channel 20*n* are added to the second low frequency channel 17*a* and the second high frequency channel 20*a* by the second adder 23*a*.

In FIG. 7A above and 7B below, the basic pan-pots are shown as sin/cos, but, again, only as an example and without loss of generality.

Figure 7B:
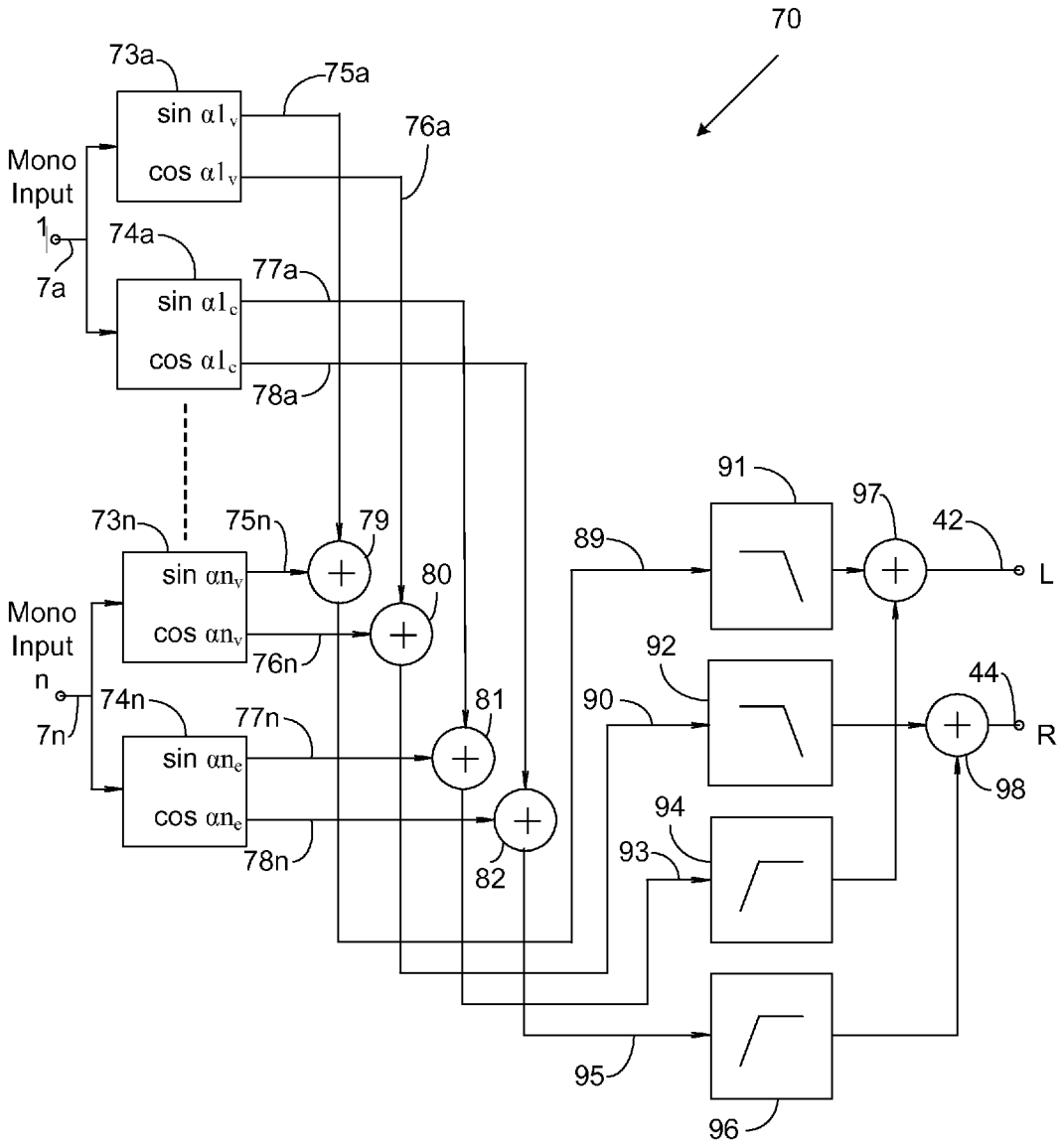
FIG. 7B illustrates a block diagram of an alternative exemplary panning apparatus that receives multiple input signals.

FIG. 7B illustrates a block diagram of an exemplary panning apparatus 70 that receives multiple mono signals 7*a* and 7*n*. In the example of FIG. 7B only two of the possibly infinite number of mono input signals 7 and corresponding blocks 73 and 74 are shown. The embodiment of FIG. 7B is an alternative to the embodiment of FIG. 7A above.

The apparatus 70 includes a first pan-pot 73*a* that receives the first input signal 7*a* and splits the input signal 7*a* into first and second channels 75*a* and 76*a*. The apparatus also includes a second pan-pot 74*a* that receives the input signal 7*a* and splits the input signal 7*a* into third and fourth channels 77*a* and 78*a* such that localization of a low frequency portion (not shown) of the first channel 75*a* coincides with localization of a high frequency portion (not shown) of the third channel 77*a* and localization of a low frequency portion (not shown) of the second channel 76*a* coincides with localization of a high frequency portion (not shown) of the fourth channel 78*a*.

The apparatus 70 also includes a third pan-pot 73*n* that receives the second input signal 7*n* and splits the input signal 7*n* into first and second channels 75*n* and 76*n*. The apparatus also includes a fourth pan-pot 74*n* that receives the second input signal 7*n* and splits the second input signal 7*n* into third and fourth channels 77*n* and 78*n* such that localization of a low frequency portion (not shown) of the first channel 75*n* coincides with localization of a high frequency portion (not shown) of the third channel 77*n* and localization of a low frequency portion (not shown) of the second channel 76*n* coincides with localization of a high frequency portion (not shown) of the fourth channel 78*n*.

The apparatus 70 also includes a first adder 79 that adds the first channels 75*a* and 75*n*, a second adder 80 that adds the second channels 76*a* and 76*n*, a third adder that 81 adds the third channels 77*a* and 77*n*, and a fourth adder 82 that adds the fourth channels 78*a* and 78*n*.

The sum 89 of the first channels 75*a* and 75*n* is applied to a low-pass filter 91, the sum 93 of the third channels 77*a* and 77*n* is applied to a high-pass pass filter 94 and the outputs summed by the summer 97 to form the first output 42. Similarly, the sum 90 of the second channels 76*a* and 76*n* is applied to a low-pass filter 92, the sum 95 of the fourth channels 78*a* and 78*n* is applied to a high-pass filter 96 and the outputs summed by the summer 98 to for the output 44.

Comparing FIGS. 7A and 7B, in FIG. 7B the band-splitting function (i.e., the filters) is moved to the output of the pan-pot array. For a single input 7, this doubles the number of filters required to four as compared to the arrangement of FIG. 7A. For arrangements with two mono inputs 7, FIG. 7B is as cost effective as FIG. 7A because they both require four filters. For arrangements including more than two mono inputs 7, FIG. 7B is more cost effective than FIG. 7A because in 7B the number of filters remains fixed to four while in FIG. 7A the number of filters increases by two with the number of inputs 7.

As stated above, the velocity vector localization may be active up to about 700 Hz (lower than this for an off-center listener) and the energy vector localization may be active from just below 700 Hz up to about 5 kHz. A suitable cross-over frequency for the disclosed low-pass filter/high-pass filter combinations is in the range 300 to 2 kHz, 600 Hz being a usable compromise over the range. The cross-over should not be too abrupt in amplitude change with frequency as this can cause audible side effects.

One suitable choice consists of two identical first order high-pass or low-pass filters in cascade for the composite high-pass or low-pass filters respectively. This is another way of saying a second order filter with a Q of 0.5, or a filter having two identical real poles. The two filters in the pair, for example filters 11 and 12 in FIGS. 4 and 7A or filters 91 and 94 or 92 and 96 in FIG. 7B, should be designed so that their outputs are in phase with each other at the cross-over frequency. This way their outputs will sum to unity voltage gain relative to their input.

If overall phase linearity is desired, then an FIR filter can be designed with a similar gain characteristic. In fact, the use of an FIR allows a much more advanced filter design to be used, but the basic principle is still as described above.

If many pan-pots are in use to produce a single stereo output, then the cross-over filters can be shared between pan-pots as shown in FIG. 7B. This can be especially cost-effective in signal processing usage when long FIR filters are in use.

The above examples correspond to panning of monophonic input signals to stereophonic (i.e., left and right) output signals. In addition to simple stereo panning, the principles disclosed herein may be applied to general pairwise panning as part of a surround program on many loudspeakers over a full sphere of directions as the energy vector and velocity vector localization theories are equally applicable to loudspeakers not necessarily in the horizontal plane as assumed in the preceding analysis. Gerzon's General Metatheory, particularly sections 4(1) "First Degree First Order Models" and 4(2) "Second Degree First Order Models," explains the 3-dimensional versions of the velocity and energy vector theories.

Figure 8:
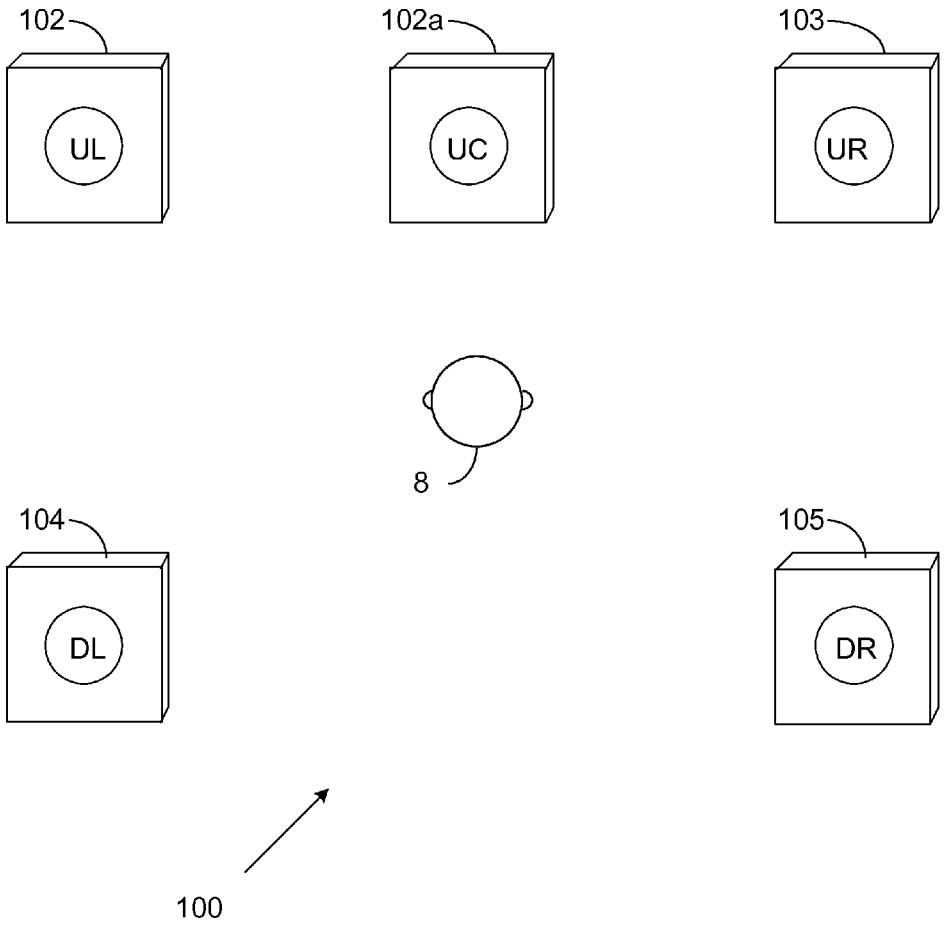
FIG. 8 illustrates an exemplary vertical loudspeaker array from the point of view of a centrally placed forward facing listener.

FIG. 8 illustrates an exemplary vertical loudspeaker array 100 from the point of view of a centrally placed forward facing listener 8. In FIG. 8, the listener 8 is facing into the page and thus FIG. 8 illustrates the back of the head of listener 8. Listener 8 is equidistant from loudspeakers 102, 102*a*, 103, 104 and 105. A panning apparatus such as the apparatus 10 of FIG. 4 may be used with, for example, loudspeaker 104 being fed from output signal 22 and loudspeaker 102 being fed from output signal 24 to provide vertical panning between the down left (DL) and up left (UL) loudspeakers.

Also, a stereo signal $L_t$, $R_t$ may be made to appear at varying heights between the upper and lower speakers by feeding $L_t$ to a first panning apparatus according to FIG. 4, with output 22 connected to speaker 104 and output 24 connected to 102, and feeding $R_t$ to a second panning apparatus according to FIG. 4 with output 22 connected to speaker 105 and output 24 connected to 103. If the same values of $\alpha_e$ and $\alpha_v$ are used for both apparatuses, the stereo signal will appear horizontal but at varying heights between the upper and lower speakers according to the setting of $\alpha_e$ and $\theta_v$ over the range defined earlier. Using different values $\alpha_e$ and $\alpha_v$ for each of the two apparatuses will give a slanting stereo signal up to the maximum of a diagonal between loudspeakers 102 and 105 or between loudspeakers 104 and 103.

Figure 9A:
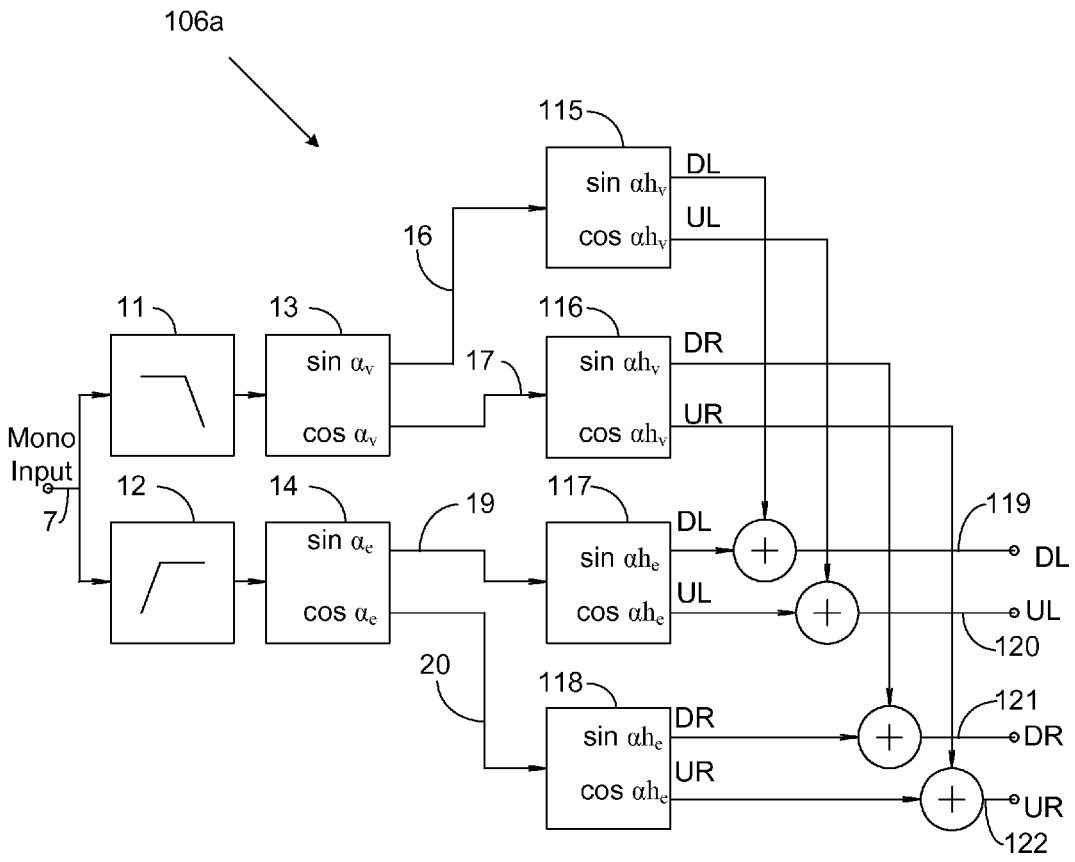
FIG. 9A illustrates a block diagram of an exemplary panning apparatus.

FIG. 9A illustrates a block diagram of an exemplary panning apparatus 106*a*. To pan a mono source over the four speaker array of FIG. 8, the panning apparatus 106*a* of FIG. 9A may be used. Low-pass filter 11 and high-pass filter 12 form a band-splitter as in FIG. 4. Pan-pot 13 splits the low frequency band into left and right low frequency portions, 16 and 17. Pan-pot 14 splits the high frequency band into left and right high frequency portions, 19 and 20.

Pan-pot 13 then feeds a second set of pan-pots 115 and 116, which are responsible for vertical panning of low-frequencies between the low-frequency pairs DL and UL, and DR and UR respectively. The angle $\alpha h_v$ is the pan-pot angle for the low-frequency vertical aspect of the compound pan-pot. Pan-pot 14 then feeds a second set of pan-pots 117 and 118, which are responsible for vertical panning of high-frequencies between the high-frequency pairs DL and UL, and DR and UR respectively. The angle $\alpha h_e$ is the pan-pot angle for the high-frequency vertical aspect of the compound pan-pot. The high and low frequency components of DL, DR, UL and UR are then recombined giving the final outputs 119, 120, 121 and 122.

The overall effect of the control described is that the horizontal position of the sound is controlled by the angles $\alpha_v$ and $\alpha_e$, and the vertical position by setting $\alpha h_v$ and $\alpha h_e$, these being mutually at right angles. The angles $\alpha_e$ and $\alpha h_v$ may be set based on the angles $\alpha_v$ and $\alpha h_e$ or vice versa as disclosed above.

Returning to FIG. 8, if instead of an upper pair of loudspeakers 102 and 103 there is a single upper loudspeaker 102*a*, then the block diagram of FIG. 9A may be simplified.

Figure 9B:
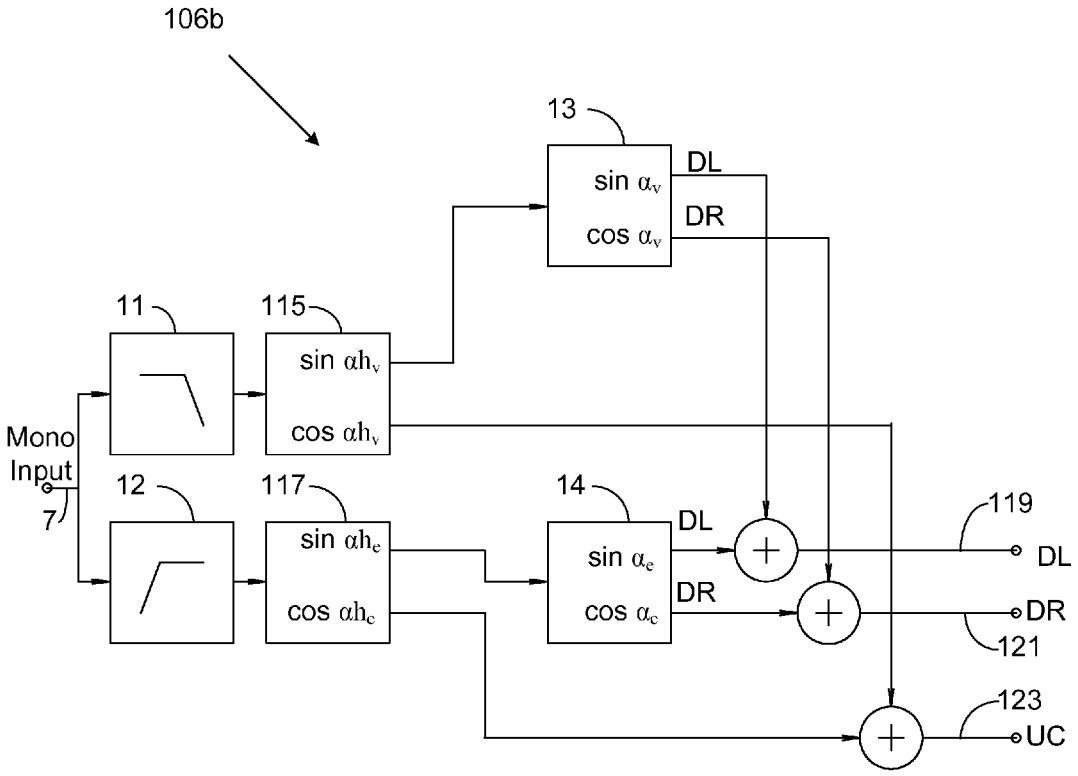
FIG. 9B illustrates a block diagram of an exemplary panning apparatus.

FIG. 9B illustrates a block diagram of an exemplary panning apparatus 106*b*. Pan-pots 116 and 118 have been removed and their input signals summed to produce the UC loudspeaker output 123. The vertical panning is then arranged to take place before the horizontal panning by interchanging the gains of pan-pots 13 with 115 and 14 with 117 and obtaining the DR signal from the cosine outputs of pan-pots 115 and 117.

The calculations of the angles $\alpha_v$, $\alpha_e$, $\alpha h_v$ and $\alpha h_e$ in FIG. 9B are similar to those for FIG. 9A. However, the image now only moves over the triangle bounded by 102*a*, 104 and 105.

The panning apparatus 106*b* is also suitable for panning over an inverted triangle with a single lower speaker and an upper pair of speakers. If in FIG. 8 DL and DR become an upper left/right pair respectively and UC moves to the line between the original position of DL and DR it is then, in FIG. 9B, only necessary to reinterpret the sense of the angles (i.e., "up" and "down" are interchanged).

Back to FIG. 8, if the y axis is on the line between DL and DR, and the z axis points vertically upwards parallel with a line through UC from the mid-point of the line between DL and DR, and the loudspeakers are equidistant from the listener 8, placed at the origin, then DL makes an angle $\theta_L$ with the x axis in the xy plane and 0 degrees with the z axis. DR makes an angle $\theta_R=\theta_L$ with the x axis, and 0 degrees with z. The third loudspeaker is at 0 degrees in the xy plane and at $\phi$ degrees with the z axis.

Using L, R and C to represent the gains the user sets for DL, DR and UC respectively, and $L_e$, $R_e$ and $C_e$ for the desired gains at high frequencies, $v_x$, $v_y$ and $v_z$ are the direction cosines of the apparent image according to the velocity vector theory, and $e_x$, $e_y$ and $e_z$ the directions cosines according to the energy vector theory, $r_v$, $r_e$ being the velocity and energy vectors respectively as before:

$$r_v \cdot v_x = \frac{(L+R)\cos\theta + C\cos\theta\cdot\cos\phi}{L+R+C} \quad \text{Eq. 41}$$

$$r_v \cdot v_y = \frac{(L-R)\sin\theta + C\sin\theta\cdot\cos\phi}{L+R+C} \quad \text{Eq. 42}$$

$$r_v \cdot v_z = \frac{C\sin\phi}{L+C+R} \quad \text{Eq. 43}$$

$$r_e \cdot e_x = \frac{(L_e^2+R_e^2)\cos\theta + C_e^2\cos\theta\cdot\cos\phi}{L_e^2+R_e^2+C_e^2} \quad \text{Eq. 44}$$

$$r_e \cdot e_y = \frac{(L_e^2-R_e^2)\sin\theta + C_e^2\sin\theta\cdot\cos\phi}{L_e^2+R_e^2+C_e^2} \quad \text{Eq. 45}$$

$$r_e \cdot e_z = \frac{C_e^2\sin\phi}{L_e^2+R_e^2+C_e^2} \quad \text{Eq. 46}$$

Ideally $r_e=r_v$ and $v_x=e_x$, $v_y=e_y$, and $v_z=e_z$ meaning that the high frequency and low frequency localization will be the same and having the same quality. Also the energy preservation requirement means $L_e^2+R_e^2+C_e^2=L^2+R^2+C^2=1$, i.e., the total high frequency power is unchanged relative to the low frequency power and equal to the input signal power. From equations 50 and 53:

$$\frac{C\sin\phi}{L+C+R} = \frac{C_e^2\sin\phi}{L_e^2+R_e^2+C_e^2} \quad \text{Eq. 47}$$

which simplifies to:

$$C_e = \sqrt{\frac{C}{L+C+R}} \quad \text{Eq. 48}$$

putting equations 48=51 and 49=52:

$$\frac{(L+R)\cos\theta + C\cos\theta\cdot\cos\phi}{L+R+C} = \frac{(L_e^2+R_e^2)\cos\theta + C_e^2\cos\theta\cdot\cos\phi}{L_e^2+R_e^2+C_e^2} \quad \text{Eq. 49}$$

-continued $$\frac{(L-R)\sin\theta + C\sin\theta\cdot\cos\phi}{L+R+C} = \frac{(L_e^2-R_e^2)\sin\theta + C_e^2\sin\theta\cdot\cos\phi}{L_e^2+R_e^2+C_e^2} \quad \text{Eq. 50}$$

simplifying and adding:

$$\frac{2L+2C\cos\phi}{L+C+R} = 2L_e^2 + \frac{2C\cos\phi}{L+C+R} \quad \text{Eq. 51}$$

gives:

$$L_e = \sqrt{\frac{L}{L+C+R}} \quad \text{Eq. 52}$$

finally, substituting back for $L_e$ and $C_e$ gives:

$$R_e = \sqrt{\frac{R}{L+C+R}} \quad \text{Eq. 53}$$

Figure 10:
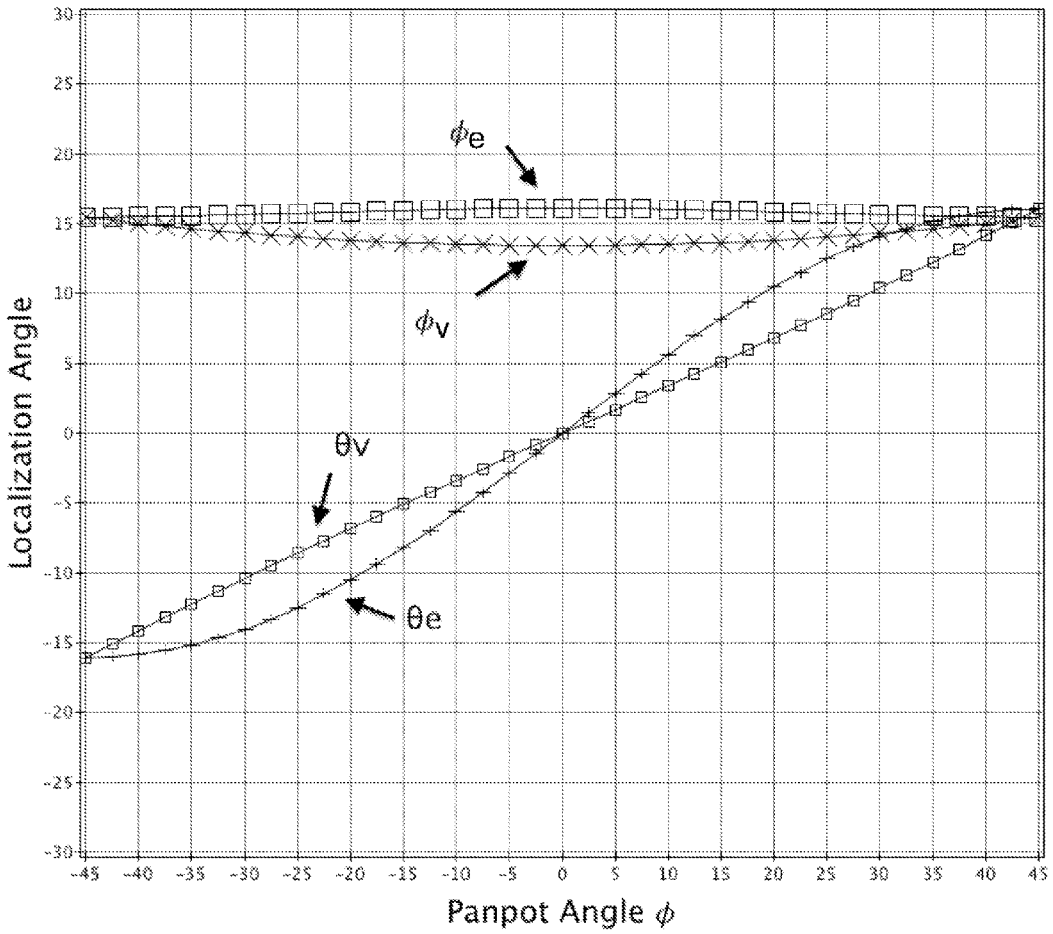
FIG. 10 illustrates a graph showing the horizontal energy and velocity vector angles for a horizontal arrangement as in FIG. 3 in addition to a vertical arrangement.

FIG. 10 shows the horizontal energy and velocity vector angles for an array with $\theta_L=-\theta_R=30$ degrees, i.e., a horizontal stage width of 60 degrees, as in FIG. 3 and in addition the vertical energy and velocity vector angles with the vertical panning angle set to a nominal value of one half the elevation of the UC loudspeaker, 30 degrees. The divergence between $\phi_v$ and $\phi_e$ can be seen particularly in the center of the range (pan-pot angle=0).

Figure 11:
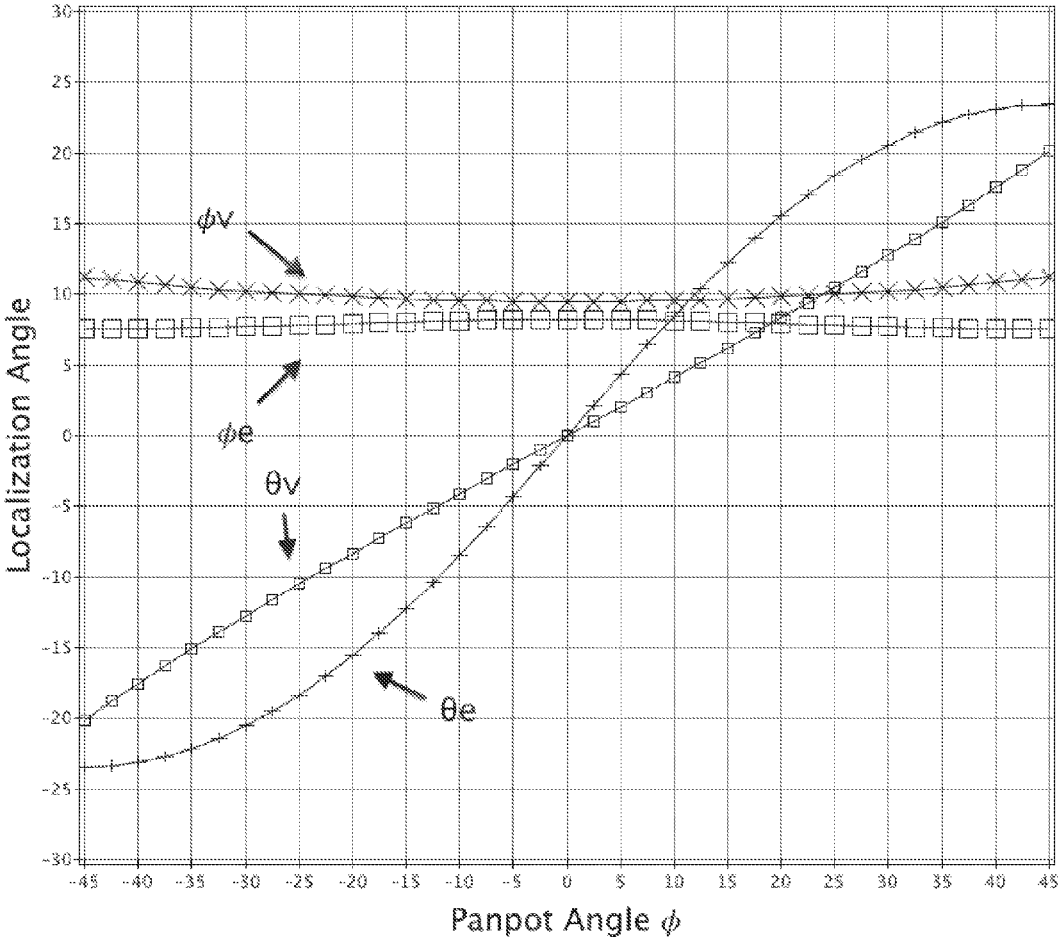
FIG. 11 illustrates a similar plot to that of FIG. 10 but with a different vertical elevation angle.

FIG. 11 is a similar plot for a vertical elevation angle of 10 degrees. It may be seen that the energy vector localization is here at a lower elevation than the velocity vector localization.

Figure 12:
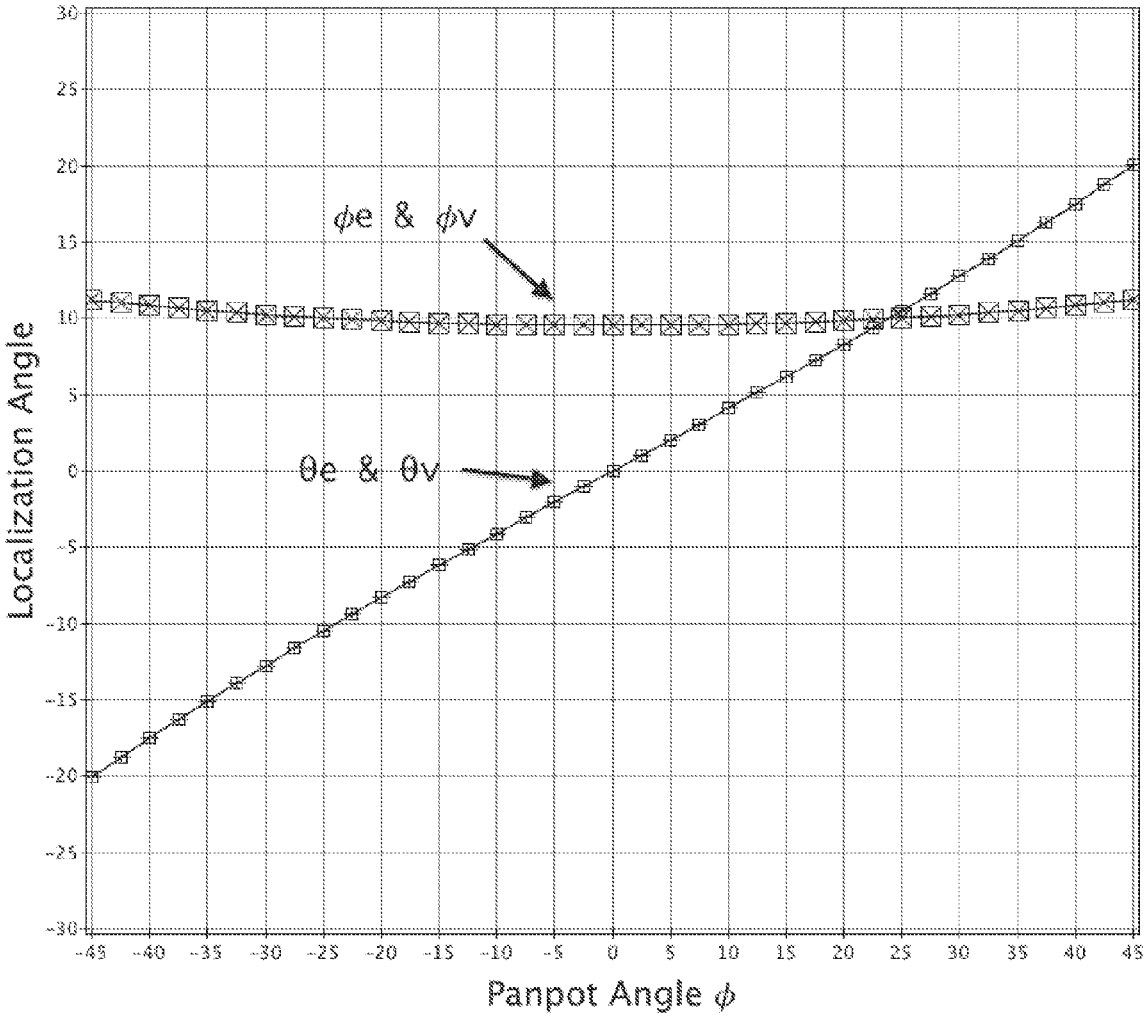
FIG. 12 shows the same conditions as FIG. 11 in which coinciding velocity and energy vector localizations appear plotted against the pan-pot angle.

FIG. 12 shows the same conditions as FIG. 11, only with the high frequency band panning values calculated using equations 55, 59 and 60.

Figure 13:
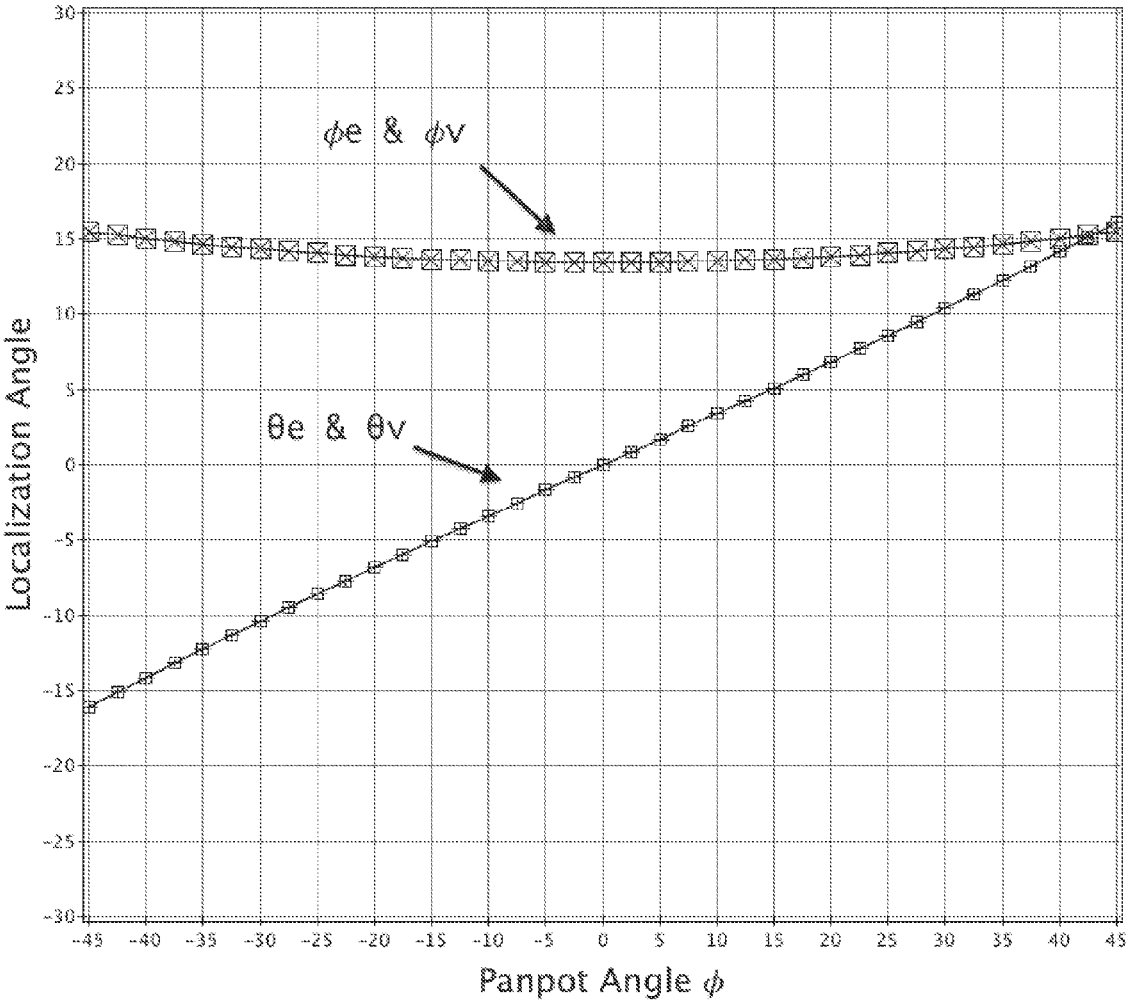
FIG. 13 shows the same conditions as FIG. 10 in which coinciding velocity and energy vector localizations appear plotted against the pan-pot angle.

FIG. 13 shows the same conditions as FIG. 10 only with the corrected values. Note also in all the plots that the maximum width shown by the horizontal energy and velocity vector plots reduces as the elevation increases, as expected as the image occupies a triangle bounded by the three loudspeakers.

Figure 14:
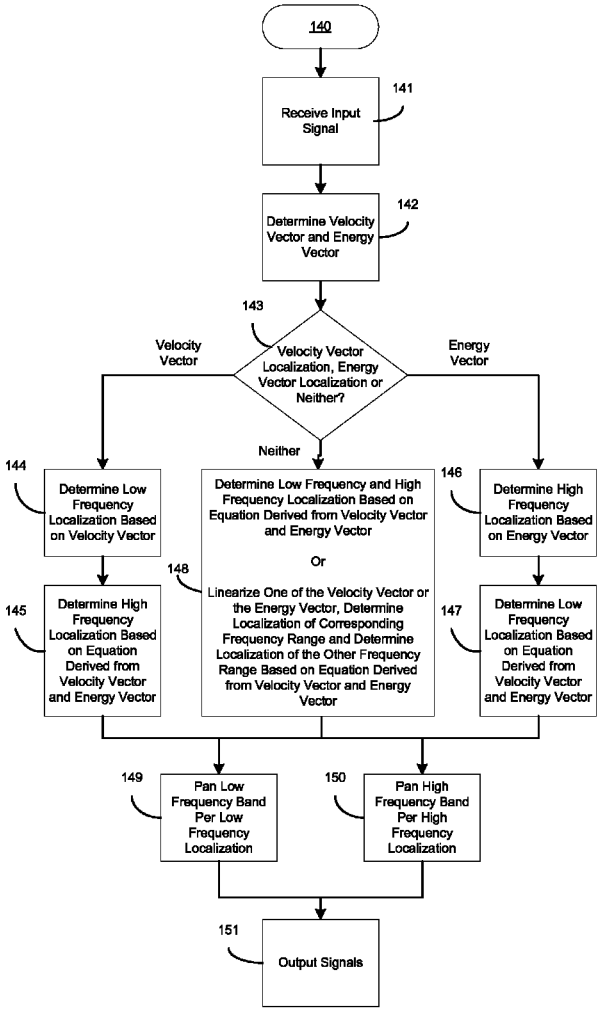
FIG. 14 illustrates a flow diagram for an exemplary method for panning.

Example methods may be better appreciated with reference to the flow diagram of FIG. 14. While for purposes of simplicity of explanation, the illustrated methodologies are shown and described as a series of blocks, it is to be appreciated that the methodologies are not limited by the order of the blocks, as some blocks can occur in different orders or concurrently with other blocks from that shown and described. Moreover, less than all the illustrated blocks may be required to implement an example methodology. Furthermore, additional methodologies, alternative methodologies, or both can employ additional blocks, not illustrated.

In the flow diagram, blocks denote "processing blocks" that may be implemented with logic. The processing blocks may represent a method step or an apparatus element for performing the method step. The flow diagrams do not depict syntax for any particular programming language, methodology, or style (e.g., procedural, object-oriented). Rather, the flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown or that blocks may be combined or separated into multiple components. It will be appreciated that the processes may be implemented using various programming approaches like machine language, procedural, object oriented or artificial intelligence techniques.

FIG. 14 illustrates a flow diagram for an exemplary method 140 for panning. The method 140 includes at 141 receiving an input signal. The input signal may be, for example, a monophonic signal to be localized between two signals of a stereophonic output. At 142, the method 140 includes determining the velocity and energy vectors for the low frequency band and the high frequency band, respectively, of the input signal according to Gerzon's General Metatheory.

At 143, the method 140 includes deciding whether to initially base localization on the velocity vector, the energy vector or both. For example, if, as shown in the example of FIG. 3, the pan control law that would be applied to the input signal results in nearly linear proportionality in $\theta_v$ with control setting, but significant divergence in $\theta_e$, the velocity vector may be chosen. Similarly, if, as shown in the example of FIG. 6, the pan control law that would be applied to the input signal results in nearly linear proportionality in $\theta_e$ with control setting, but significant divergence in $\theta_v$, the energy vector may be chosen.

In one embodiment, where the pan control law that would be applied to the input signal results in similar proportionality or divergence in $\theta_v$ and $\theta_e$, localization may be based on neither (or both). In one embodiment, where the pan control law that would be applied to the input signal results in similar divergence in $\theta_v$ and $\theta_e$, a different pan-pot law may be designed or chosen such that one of $\theta_v$ and $\theta_e$, gives a linear graph (at the desired angle subtended by the speakers at the listener, as it does vary a small amount with angle). Then the other one of $\theta_v$ and $\theta_e$ may be determined as explained above to match the linearity of the first curve.

If the velocity vector is chosen, at 144 the method 140 determines low frequency localization based on the velocity vector and, at 145, determines high frequency localization as a function of the low frequency localization based on an equation (e.g., Eq. 21 or Eqs. 29 and 30) derived from the velocity vector and the energy vector. If the energy vector is chosen, at 146 the method 140 determines high frequency localization based on the energy vector and, at 147, determines low frequency localization as a function of the high frequency localization based on an equation (e.g., Eqs. 44 and 45) derived from the velocity vector and the energy vector.

Finally, if neither the velocity and energy vectors are chosen, at 148 the method 140 determines low and high frequency localization as a combined function based on an equation derived from both the velocity vector and the energy vector. Or the method 140 first linearizes one of $\theta_v$ or $\theta_e$ and determines localization of the first frequency range corresponding to the linearized vector (i.e., velocity vector for low frequency range or energy vector for high frequency range). The method 140 may then determine localization of the second frequency range to match the linearity of the first frequency range as a function of the localization of the first frequency range based on an equation (e.g., Eqs. 21, 29 and 30, or 44 and 45) derived from the velocity vector and the energy vector.

At 149, the method 140 pans the low frequency band of the input signal based on the calculated low frequency localization and, at 150, the method 140 pans the high frequency band of the input signal based on the calculated high frequency localization.

At 151, the method 140 outputs the output signals.

While FIG. 14 illustrates various actions occurring in serial, it is to be appreciated that various actions illustrated could occur substantially in parallel, and while actions may be shown occurring in parallel, it is to be appreciated that these actions could occur substantially in series. While a number of processes are described in relation to the illustrated methods, it is to be appreciated that a greater or lesser number of processes could be employed and that lightweight processes, regular processes, threads, and other approaches could be employed. It is to be appreciated that other example methods may, in some cases, also include actions that occur substantially in parallel. The illustrated exemplary methods and other embodiments may operate in real-time, faster than real-time in a software or hardware or hybrid software/hardware implementation, or slower than real time in a software or hardware or hybrid software/hardware implementation.

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

The invention claimed is:

1. A panning apparatus comprising:

an input configured to receive a monophonic input signal;

a low frequency pan-pot configured to receive a low frequency portion of the monophonic input signal and to split the low frequency portion into first and second low frequency channels, the low frequency pan-pot configured to localize the low frequency portion between the first and second low frequency channels according to a low frequency pan control law;

a high frequency pan-pot configured to receive a high frequency portion of the monophonic input signal and to split the high frequency portion into first and second high frequency channels, the high frequency pan-pot configured to localize the high frequency portion between the first and second high frequency channels according to a high frequency pan control law;

a first adder configured to add the first low frequency channel and the first high frequency channel to form a first output signal;

a second adder configured to add the second low frequency channel and the second high frequency channel to form a second output signal; and an output configured to output the first output signal and the second output signal, wherein the low frequency pan control law and the high frequency pan control law are different and the low frequency pan-pot and the high frequency pan-pot are configured to localize the low frequency portion between the first and second low frequency channels according to the low frequency pan control law and to localize the high frequency portion between the first and second high frequency channels according to the high frequency pan control law, respectively, such that localization of the high frequency portion between the first and second high frequency channels substantially coincides with localization of the low frequency portion between the first and second low frequency channels.

2. The panning apparatus of claim 1, wherein the high frequency pan control law is a function of the low frequency pan control law or the low frequency pan control law is a function of the high frequency pan control law.

3. The panning apparatus of claim 1, wherein the low frequency pan-pot is configured to localize the low frequency portion between the first and the second low frequency channels according to a velocity vector localization or the high frequency pan-pot is configured to localize the high frequency portion between the first and the second high frequency channels according to an energy vector localization.

4. The panning apparatus of claim 1, wherein the low frequency pan-pot is configured to localize the low frequency portion between the first and the second low frequency channels according to a velocity vector localization, and the high frequency pan-pot is configured to localize the high frequency portion between the first and the second high frequency channels such that localization of the low frequency portion between the first and the second low frequency channels coincides with localization of the high frequency portion between the first and the second high frequency channels.

5. The panning apparatus of claim 1, wherein the high frequency pan-pot is configured to localize the high frequency portion between the first and the second high frequency channels according to an energy vector localization, and the low frequency pan-pot is configured to localize the low frequency portion between the first and the second low frequency channels such that localization of the low frequency portion between the first and the second low frequency channels substantially coincides with localization of the high frequency portion between the first and the second high frequency channels.

6. The panning apparatus of claim 1, wherein the high frequency pan control law is derived from an energy vector localization and the low frequency pan control law is derived from a velocity vector localization.

7. The panning apparatus of claim 1, wherein the first and second low frequency channels correspond to left and right low frequency channels, respectively, or to up and down low frequency channels, respectively;

the first and second high frequency channels correspond to left and right high frequency channels, respectively, or to up and down high frequency channels, respectively; and the first and second output signals correspond to left and right output signals, respectively, or to up and down output signals, respectively.

8. The panning apparatus of claim 1, wherein at least one of:

the first and second output signals correspond to stereophonic audio, or total output power of the first and second output signals is constant regardless of localization.

9. The panning apparatus of claim 1, wherein the low frequency pan-pot is configured to receive the low frequency portion of the monophonic input signal and to split the low frequency portion into the first and second low frequency channels and a third low frequency channel to localize the low frequency portion between the first, second and third low frequency channels;

the high frequency pan-pot is configured to receive the high frequency portion of the monophonic input signal and to split the high frequency portion into the first and second high frequency channels and a third high frequency channel to localize the high frequency portion between the first, second and third high frequency channels;

the panning apparatus comprising:

a third adder configured to add the third low frequency channel and the third high frequency channel to form a third output signal, wherein the output configured to output the first output signal, the second output signal, and the third output signal.

10. The panning apparatus of claim 9, wherein the first, second and third output signals are configured to be provided to first, second and third loudspeaker, respectively, disposed horizontally, vertically or diagonally relative to each other.

11. The panning apparatus of claim 1, wherein the first output signal is configured to be provided to a first loudspeaker and the second output signal is configured to be provided to a second loudspeaker disposed horizontally, vertically or diagonally relative to the first loudspeaker.

12. The panning apparatus of claim 1, wherein the input is configured to receive the monophonic input signal and a second monophonic input signal, the apparatus comprising:

a second low frequency pan-pot that configured to receive a low frequency portion of the second monophonic input signal and to split the low frequency portion of the second monophonic input signal into first and second low frequency channels of the second monophonic input signal to localize the low frequency portion of the second monophonic input signal between the first and second low frequency channels of the second monophonic input signal;

a second high frequency pan-pot that configured to receive a high frequency portion of the second monophonic input signal and to split the high frequency portion of the second monophonic input signal into first and second high frequency channels of the second monophonic input signal to localize the high frequency portion of the second monophonic input signal between the first and second high frequency channels of the second monophonic input signal to substantially coincide with the localization of the low frequency portion of the second monophonic input signal between the first and second low frequency channels of the second monophonic input signal, wherein the first adder or a third adder is configured to add the low frequency channel of the second monophonic input signal and the first high frequency channel of the second monophonic input signal to the low frequency channel of the first monophonic input signal and the first high frequency channel of the first monophonic input signal to form the first output signal, and the second adder or a fourth adder is configured to add the second low frequency channel of the second monophonic input signal and the second high frequency channel of the second monophonic input signal to the second low frequency channel of the first monophonic input signal and the second high frequency channel of the first monophonic input signal to form the second output signal.

13. The panning apparatus of claim 1, wherein the input is configured to receive the monophonic input signal and a second monophonic input signal, the apparatus comprising:

a second low frequency pan-pot is configured to receive a low frequency portion of the second monophonic input signal and to split the low frequency portion of the second monophonic input signal into third and fourth low frequency channels to localize the low frequency portion of the second monophonic input signal between the third and fourth low frequency channels;

a second high frequency pan-pot is configured to receive a high frequency portion of the second monophonic input signal and to split the high frequency portion of the second monophonic input signal into third and fourth high frequency channels to localize the high frequency portion of the second monophonic input signal between the third and fourth high frequency channels to substantially coincide with the localization of the low frequency portion of the second monophonic input signal between the third and fourth low frequency channels;

a third adder configured to add the third low frequency channel and the third high frequency channel to form a third output signal;

a fourth adder configured to add the fourth low frequency channel and the fourth high frequency channel to form a fourth output signal, wherein the output configured to output the first output signal, the second output signal, the third output signal and the fourth output signal.

14. A panning apparatus comprising:

an input configured to receive a monophonic input signal;

a first pan-pot configured to receive the monophonic input signal and is configured to split the monophonic input signal into first and second channels according to a first pan control law;

a second pan-pot configured to receive the monophonic input signal and is configured to split the monophonic input signal into third and fourth channels according to a second pan control law different from the first pan control law;

a first adder configured to add a low frequency signal including at least the low frequency portion of the first channel and a first high frequency signal including at least the high frequency portion of the third channel to form a first output signal;

a second adder configured to add a second low frequency signal including at least the low frequency portion of the second channel and a second high frequency signal including at least the high frequency portion of the fourth channel to form a second output signal; and an output configured to output the first output signal and the second output signal, wherein the first pan-pot and the second pan-pot are configured to localize the first and the second channels according to the first pan control law and the third and the fourth channels according to the second pan control law, respectively, such that localization of a low frequency portion of the first channel substantially coincides with localization of a high frequency portion of the third channel and localization of a low frequency portion of the second channel coincides with localization of a high frequency portion of the fourth channel.

15. The panning apparatus of claim 14, wherein the first pan-pot is configured to split the monophonic input signal according to a velocity vector localization or the second pan-pot is configured to split the monophonic input signal according to an energy vector localization.

16. The panning apparatus of claim 14, wherein the first pan-pot is configured to split the monophonic input signal according to a velocity vector localization and the second pan-pot is configured to split the monophonic input signal such that localization of the low frequency portion of the first channel substantially coincides with localization of the high frequency portion of the third channel and localization of the low frequency portion of the second channel substantially coincides with localization of the high frequency portion of the fourth channel.

17. The panning apparatus of claim 14, wherein the second pan-pot is configured to split the monophonic input signal according to an energy vector localization and the first pan-pot is configured to split the monophonic input signal such that localization of the low frequency portion of the first channel substantially coincides with localization of the high frequency portion of the third channel and localization of the low frequency portion of the second channel substantially coincides with localization of the high frequency portion of the fourth channel.

18. The panning apparatus of claim 14, wherein the second pan control law is derived from an energy vector localization and the first pan control law is derived from a velocity vector localization.

19. The panning apparatus of claim 14, wherein the first and second output signals correspond to stereophonic audio, and total output power of the first and second output signals is constant regardless of localization.

20. The panning apparatus of claim 14, wherein the first pan-pot is configured to receive the monophonic input signal and is configured to split the monophonic input signal into the first and second channels and a fifth channel;

the second pan-pot is configured to receive the monophonic input signal and is configured to split the monophonic input signal into the third and fourth channels and a sixth channel such that localization of a low frequency portion of the fifth channel substantially coincides with localization of a high frequency portion of the sixth channel;

the panning apparatus comprising:

a third adder configured to add the low frequency portion of the fifth channel and the high frequency portion of the sixth channel to form a third output signal, wherein the output is configured to output the first output signal, the second output signal and the third output signal.

21. The panning apparatus of claim 20, wherein the first, second and third output signals are configured to be provided to first, second and third loudspeaker, respectively, disposed horizontally, vertically or diagonally relative to each other.

22. The panning apparatus of claim 14, wherein the first output signal is configured to be provided to a first loudspeaker and the second output signal is configured to be provided to a second loudspeaker disposed horizontally, vertically or diagonally relative to the first loudspeaker.

23. The panning apparatus of claim 14, wherein the monophonic input is configured to receive the monophonic input signal and a second monophonic input signal, the apparatus comprising:

a third pan-pot configured to receive the monophonic input signal and is configured to split the monophonic input signal into fifth and sixth channels;

a fourth pan-pot configured to receive the monophonic input signal and is configured to split the monophonic input signal into seventh and eighth channels such that localization of a low frequency portion of the fifth channel substantially coincides with localization of a high frequency portion of the seventh channel and localization of a low frequency portion of the sixth channel substantially coincides with localization of a high frequency portion of the eighth channel;

a third adder configured to add the first channel and the fifth channel;

a fourth adder configured to add the second channel and the sixth channel;

a fifth adder configured to add the third channel and the seventh channel; and a sixth adder configured to add the fourth channel and the eighth channel.

24. The panning apparatus of claim 23, comprising:

a low pass filter configured to filter the output of the third adder to form the low frequency signal;

a first high pass filter configured to filter the output of the fourth adder to form the first high frequency signal;

a second low pass filter configured to filter the output of the fifth adder to form the second low frequency signal; and a second high pass filter configured to filter the output of the sixth adder to form the second high frequency signal.

25. A method of panning, comprising receiving a monophonic input signal;

panning the monophonic input signal or a low frequency portion of the monophonic input signal to split the monophonic input signal or the low frequency portion of the monophonic input signal into first and second channels according to a first pan control law;

panning the monophonic input signal or a high frequency portion of the monophonic input signal to split the monophonic input signal or the high frequency portion of the monophonic input signal into third and fourth channels according to a second pan control law different from the first pan control law, wherein the monophonic input signal or the low frequency portion of the monophonic input signal is split into the first and second channels according to the first pan control law and the monophonic input signal or the high frequency portion of the monophonic input signal is split into third and fourth channels according to the second pan control law such that localization of the high frequency portion of the monophonic input signal coincides with localization of the low frequency portion of the monophonic input signal;

adding a low frequency signal including the first channel or at least a low frequency portion of the first channel to a first high frequency signal including the third channel or at least a high frequency portion of the third channel to form a first output signal;

adding a second low frequency signal including the second channel or at least a low frequency portion of the second channel to a second high frequency signal including the fourth channel or at least a high frequency portion of the fourth channel to form a second output signal; and outputting the first output signal and the second output signal.

26. The method of claim 25, wherein the panning the monophonic input signal or the low frequency portion of the monophonic input signal to split the monophonic input signal or the low frequency portion of the monophonic input signal into the first and second channels localizes the low frequency portion of the monophonic input signal between the first and the second channels according to a velocity vector localization, or the panning the monophonic input signal or the high frequency portion of the monophonic input signal to split the monophonic input signal or the high frequency portion of the monophonic input signal into the third and fourth channels localizes the high frequency portion of the monophonic input signal between the third and fourth channels according to an energy vector localization.

27. The method of claim 25, wherein the panning the monophonic input signal or the low frequency portion of the monophonic input signal to split the monophonic input signal or the low frequency portion of the monophonic input signal into the first and second channels localizes the low frequency portion of the monophonic input signal between the first and the second channels according to a velocity vector localization, and the panning the monophonic input signal or the high frequency portion of the monophonic input signal to split the monophonic input signal or the high frequency portion of the monophonic input signal into the third and fourth channels localizes the high frequency portion of the monophonic input signal between the third and fourth channels such that localization of the low frequency portion of the monophonic input signal between the first and the second channels coincides with localization of the high frequency portion of the monophonic input signal between the third and fourth channels.

28. The method of claim 25, wherein the panning the monophonic input signal or the high frequency portion of the monophonic input signal to split the monophonic input signal or the high frequency portion of the monophonic input signal into the third and fourth channels localizes the high frequency portion of the monophonic input signal between the third and fourth channels according to an energy vector localization, and the panning the monophonic input signal or the low frequency portion of the monophonic input signal to split the monophonic input signal or the low frequency portion of the monophonic input signal into the first and second channels localizes the low frequency portion of the monophonic input signal between the first and the second channels such that localization of the low frequency portion of the monophonic input signal between the first and the second channels coincides with localization of the high frequency portion of the monophonic input signal between the third and fourth channels.

29. The method of claim 25, wherein the first pan control law is at least one of:

different from the second pan control law and a function of the second pan control law, different from the second pan control law and the second pan control law is a function of the first pan control law, equal to the second pan control law and derived from an energy vector localization and a velocity vector localization.

30. A method of panning, comprising receiving a monophonic input signal;

determining a velocity vector and an energy vector of a pan control law applied to the monophonic input signal;

determining at least one of low frequency localization and high frequency localization based on an equation derived from both the velocity vector and the energy vector;

panning a low frequency band of the monophonic input signal according to the low frequency localization; and panning a high frequency band of the monophonic input signal according to the high frequency localization.

31. The method of claim 30, comprising:

determining the low frequency localization based on the velocity vector and the high frequency localization as a function of the low frequency localization based on the equation derived from both the velocity vector and the energy vector.

32. The method of claim 30, comprising:

determining the high frequency localization based on the energy vector and the low frequency localization as a function of the high frequency localization based on the equation derived from both the velocity vector and the energy vector.

33. The method of claim 30, comprising:

determining both the low frequency localization and the high frequency localization based on the equation derived from both the velocity vector and the energy vector.

* * * * *